US012492547B1

(12) United States Patent
Greene

(10) Patent No.: US 12,492,547 B1
(45) Date of Patent: Dec. 9, 2025

(54) SUPPORT-TO-STRUCTURE INTERFACE DEVICES AND METHODS FOR SUPPORTING A STRUCTURE

(71) Applicant: D.A. Collins Construction Co., Inc., Wilton, NY (US)

(72) Inventor: Koby J. Greene, East Greenbush, NY (US)

(73) Assignee: D. A. COLLINS CONSTRUCTION CO., INC., Wilton, NY (US)

( * ) Notice: Subject to any disclaimer, the term of this patent is extended or adjusted under 35 U.S.C. 154(b) by 178 days.

(21) Appl. No.: 18/532,633

(22) Filed: Dec. 7, 2023

Related U.S. Application Data

(60) Provisional application No. 63/488,839, filed on Mar. 7, 2023, provisional application No. 63/387,732, filed on Dec. 16, 2022.

(51) Int. Cl.
*E04B 1/24* (2006.01)

(52) U.S. Cl.
CPC .... *E04B 1/2403* (2013.01); *E04B 2001/2415* (2013.01); *E04B 2001/2439* (2013.01)

(58) Field of Classification Search
CPC ..... E04B 1/2403; E04B 2001/2415; E04B 2001/2439
See application file for complete search history.

(56) References Cited

U.S. PATENT DOCUMENTS 4,188,681 A * 2/1980 Tada ..... B23Q 1/5462 248/182.1
5,014,474 A * 5/1991 Fyfe ..... E02D 31/08 248/634

(Continued)

FOREIGN PATENT DOCUMENTS

CN 208633137 U 3/2019
CN 215236940 U 12/2021

(Continued)

OTHER PUBLICATIONS

Ceiling Mount Adapter, Zoro.com, https://www.zoro.com/video-mount-products-mount-ceiling-25-lb-load-cap-whitecca1/i/G6523769/?utm_source=google&utm_medium=surfaces&utm_campaign=shopping%20feed&utm_content=free%20google%20shopping%20clicks &gclid=EAlalQobChMI25PvzYPJQIVg8LCBB03vQq5EAQYAyABEgK4LvD_BwE, Retrieved on Aug. 16, 2022, 5 pages.

*Primary Examiner* — Rodney Mintz
(74) *Attorney, Agent, or Firm* — Tech Valley Patent, LLC; John Pietrangelo

(57) ABSTRACT

Support-to-structure interface devices and methods for supporting a structure are disclosed. The interface devices include mounting surfaces having relative orientations that can be varied to accommodate misalignments in mating surfaces between a support, for example, a column, and a structure, for example, an overhead beam. The interface devices include a top assembly adapted to engage a structure and a bottom assembly adapted to engage a support, where the top assembly and the bottom assembly have radiused bearing surfaces that allow the assemblies to vary their relative orientations to address any misalignment between a support and a structure. The top assembly and the bottom assembly may be connected by a tether, for example, a tether mounted to tether plates. Though uniquely adapted for highly loaded bridge and overpass construction, aspects of the invention can be adapted for use in a broad range of applications requiring engagement of misaligned supports and structures.

20 Claims, 21 Drawing Sheets

(56) References Cited

U.S. PATENT DOCUMENTS

| | | | | |
|---|---|---|---|---|
| 6,324,795 | B1 * | 12/2001 | Stiles | E02D 27/34 52/167.7 |
| 6,681,538 | B1 * | 1/2004 | Sarkisian | E04C 3/06 52/289 |
| 7,000,304 | B2 * | 2/2006 | Sarkisian | E04B 1/2403 29/434 |
| 8,777,176 | B2 * | 7/2014 | Genschorek | F24S 25/12 248/156 |
| 9,556,621 | B2 | 1/2017 | Pelc et al. | |
| 9,915,079 | B2 * | 3/2018 | Shu | E04H 9/14 |
| 10,822,761 | B1 * | 11/2020 | Voyen | E04G 25/04 |
| 11,136,779 | B2 * | 10/2021 | Kim | E04B 1/36 |
| 11,306,458 | B1 * | 4/2022 | Wells | E02D 37/00 |
| 11,814,809 | B1 * | 11/2023 | Tran | E02D 35/00 |
| 2004/0010992 | A1 * | 1/2004 | Sarkisian | E04D 13/00 52/289 |
| 2004/0247378 | A1 * | 12/2004 | Sarkisian | E04D 13/00 403/83 |
| 2010/0127142 | A1 * | 5/2010 | Genschorek | F24S 25/70 248/220.21 |
| 2016/0040439 | A1 * | 2/2016 | Pelc | E04F 15/0247 52/126.6 |
| 2017/0044789 | A1 * | 2/2017 | Shu | E02D 27/34 |
| 2020/0024851 | A1 | 1/2020 | Rivelli et al. | |
| 2020/0039801 | A1 | 2/2020 | Sargent et al. | |
| 2021/0140188 | A1 * | 5/2021 | Kim | E04B 1/36 |

FOREIGN PATENT DOCUMENTS

| | | | |
|---|---|---|---|
| DE | 4022962 | A | 1/1991 |
| DE | 202005003011 | U | 5/2005 |
| DE | 102010032452 | A | 2/2012 |
| KR | 200393179 | Y | 8/2005 |
| KR | 100768724 | B | 10/2007 |
| KR | 100903993 | B1 | 6/2009 |
| KR | 101248860 | B | 3/2013 |
| WO | 2009122164 | A1 | 10/2009 |
| WO | 2013098206 | A1 | 7/2013 |

* cited by examiner

SUPPORT-TO-STRUCTURE INTERFACE DEVICES AND METHODS FOR SUPPORTING A STRUCTURE

CROSS-REFERENCE TO RELATED APPLICATION

This application claims priority from U.S. Provisional Patent Application 63/387,732, filed on Dec. 16, 2022, and from U.S. Provisional Patent Application 63/488,839, filed on Mar. 7, 2023, the disclosures of which are included by reference herein in their entirety.

BACKGROUND OF THE INVENTION

Technical Field

The present invention generally relates to structural supports, for example, for bridge or for overpass construction. More particularly, the present invention relates to a support-to-structure interface that can be used to engage a support, for example, a column, with a structure, for example, an overhead beam, that are misaligned by varying the orientation of the mating surfaces of the support-to-structure interface.

Description of Related Art

In many applications, for example, road construction, bridge construction, and building construction, among others, structural supports are provided to transfer loads, for example, the weight of a structure, to stable ground or to another intermediate structure. Typically, when a support is designed for a structure, for example, an overhead structure, care is taken to ensure that that the interfaces of mating structures are aligned, for example, lie in substitutable the same horizontal plane to properly engage and transmit load from the structure to the support, for example, when connected with approximate hardware, such as, nuts and bolts.

However, sometimes the mating surfaces of the support, for example, a column or a post, and of the structure being supported do not align, that is, are not in the same plane or are not in parallel planes, and the desired mating of such surfaces to properly connect and transmit loads is not provided. This misalignment of mating surfaces may occur when repairing or re-enforcing existing structural supports, when providing new structural supports when none existed before, or when providing temporary structural support while repairing or replacing an adjacent or associated structure or support. In such instances, when the mating surfaces of the structure requiring support, for example, an overhead beam, and the supporting structure, for example, column, are not aligned, some modification to the interface between the mating surfaces must be provided to ensure a desired load-carrying capacity.

For example, according to existing practice, the mating of a structure with a support column may require the fabrication of a unique interface, that is, a unique structural interface specifically designed to engage the misaligned mating surfaces to properly transfer the loading from the structure to the support column. Due to the expected loading, such unique interfaces may typically comprise steel weldments having steel plates oriented at the desired engagement angle and supported by appropriate steel gusset plates and/or ribs welded to the plates. Shims, for example, tapered shims or graduated (that is, stepped) shims, may be used between mating surfaces to ensure appropriate engagement and support. Should multiple misaligned structures and plates be required, multiple unique interface devices typically must be fabricated for each of the multiple supports.

Aspects of the present invention overcome the disadvantages and limitations of these and other prior art devices and methods for providing support to structures and their supports having mating surfaces that do not align.

SUMMARY OF THE INVENTION

Embodiments of the present invention provide devices and methods for supporting structures, for example, overhead beams, with vertical supports, such as, columns, when the mating surfaces of the structure and support are misaligned. Aspects of the invention provide devices and methods employing structure-to-column interface devices between a structure being supported and the vertical support that can vary the angle of orientation of engagement to ensure a proper engagement of the support with the structure to ensure proper transfer of loading to the support. Though aspects of the invention may be uniquely adapted for using in the temporary support of a structure, for example, an overhead beam being serviced, other aspects of the invention can be adapted for long term support, for example, for the life of the structure being supported. In one aspect, the device of the invention may be referred to as "an adjustable column top." In another aspect, the device of the invention may be referred as "a shoring post adjustable cap."

One embodiment of the invention is a support-to-structure interface device comprising or including: a top assembly having a top plate adapted to engage a structure, for example, a beam, and a bearing ring mounted to the top plate, the bearing ring having a first radiused bearing surface and a second radiused bearing surface, opposite the first radiused bearing surface; a bottom assembly having a bottom plate adapted to engage a vertical support, for example, a column, and a third radiused bearing surface adapted and shaped to contact the first radiused bearing surface of the top assembly; a retaining ring having a fourth radiused bearing surface adapted and shaped to contact the second bearing surface of the top assembly; and a fastener adapted to retain the top assembly on the bottom assembly. In one aspect of the device, the top assembly may further include a mounting cylinder, for example, a circular cylindrical mounting cylinder, positioned between the top plate and the bearing ring.

In one aspect of the device, the bottom assembly may further include a bearing dome, for example, a spherical bearing dome, and wherein the third radiused bearing surface is located on the bearing dome.

In one aspect of the device, the top assembly may be rotatable against the bottom assembly about at least one axis, preferably, about at least two axes.

In another aspect of the device, the device may further include at least one lubrication channel or groove in the first radiused bearing surface of the bearing ring, the second radiused bearing surface of the bearing ring, the third radiused bearing surface of bottom assembly, and/or the fourth radiused bearing surface of the retaining ring. The at least one lubrication channel or groove may be provided with a lubrication fluid, such as, grease, through ports and/or passages in the respective structures.

Another embodiment of the invention is a method for supporting a structure, the method comprising or including: mounting a top assembly to a structure, for example, to a beam, the top assembly comprising a top plate adapted to engage the structure and a bearing ring mounted to the top plate, the bearing ring having a first radiused bearing surface and a second radiused bearing surface, opposite the first radiused bearing surface; mounting a bottom assembly to a vertical support, for example, a column, the bottom assembly having a bottom plate adapted to engage the vertical support and a third radiused bearing surface adapted and shaped to contact the first radiused bearing surface of the top assembly; at least partially retaining the top assembly onto the bottom assembly with a retaining ring and a fastener, the retaining ring having a fourth radiused bearing surface adapted and shaped to contact the second bearing surface of the top assembly; rotating the partially retained bottom assembly with respect to the top assembly to provide a desired orientation of the bottom assembly relative to the top assembly; and retaining the bottom assembly in the desired orientation by tightening the fastener.

In one aspect of the method, rotating the partially retained bottom assembly with respect to the top assembly may be practiced by slidably engaging the third radiused bearing surface of the bottom assembly with the first radiused bearing surface of the top assembly. In another aspect of the method, rotating the partially retained bottom assembly with respect to the top assembly may further be practiced by slidably engaging the fourth radiused bearing surface of the bearing ring with the second radiused bearing surface of the top assembly.

In one aspect of the method, rotating the partially retained bottom assembly with respect to the top assembly may be practiced with a moment arm operativity connected to the bottom assembly.

In another aspect of the method, the desired orientation may be alignment of a surface of the top plate of the top assembly with a surface of the structure and alignment of a surface of the bottom plate of the bottom assembly with a surface of the support.

In a further aspect of the method of the invention, the device may further include at least one lubrication channel or groove in the first radiused bearing surface of the bearing ring, the second radiused bearing surface of the bearing ring, the third radiused bearing surface of bottom assembly, and/or the fourth radiused bearing surface of the retaining ring, and the method may further include introducing a fluid lubricant, such as, grease, to one or more of these radiused bearing surfaces.

A further embodiment of the invention is a column-to-structure interface device comprising or including: a top assembly having a top plate adapted to engage a structure and a bearing ring mounted to the top plate, the bearing ring having a first radiused bearing surface and a second radiused bearing surface, opposite the first radiused bearing surface; a bottom assembly having a bottom plate adapted to engage a column and a third radiused bearing surface adapted and shaped to contact the first radiused bearing surface of the top assembly, wherein the top assembly is rotatable against the bottom assembly about at least one axis; a mounting cylinder positioned between the top plate and the bearing ring; a retaining ring having a fourth radiused bearing surface adapted and shaped to contact the second bearing surface of the top assembly; and a fastener adapted to retain the top assembly on the bottom assembly. In one aspect of the device, the mounting cylinder may be a circular cylindrical mounting cylinder or a polygonal cylindrical mounting cylinder.

In one aspect, the interface devices disclosed herein may include at least one tether, for example, a chain or a cable, having a first end mounted to the top assembly and a second end mounted to the bottom assembly. In one aspect, the at least one tether may have the first end mounted to the top plate of the top assembly and the second end mounted to the bottom plate of the bottom assembly. In one aspect, the at least one tether may be two tethers or at least two tethers.

In one aspect, the top plate of the top assembly may further comprise a perforated tether plate and the bottom plate of the bottom assembly may further comprise a perforated tether plate, and wherein the first end of the at least one tether may be mounted to the perforated tether plate of the top plate and the second end of the at least one tether may be mounted to the perforated tether plate of the bottom plate.

In one aspect, the top plate of the top assembly may further comprise two perforated tether plates and the bottom plate of the bottom assembly may further comprise two perforated tether plates, and wherein a first end of each of the two tethers may be mounted to one of the two perforated tether plates of the top plate and a second end of each of the two tethers may be mounted to one of the two perforated tether plates of the bottom plate.

In one aspect, the method disclosed herein may including mounting at least one tether, for example, two tethers, to the top assembly and to the bottom assembly. In one aspect, the mounting at least one tether may be practiced by mounting the at least one tether to the top plate of the top assembly and to the bottom plate of the bottom assembly, for example, mounting the at least one tether to perforated tether plates on the top plate and to perforated tether plates on the bottom plate.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF ASPECTS OF THE INVENTION

Figure 1:
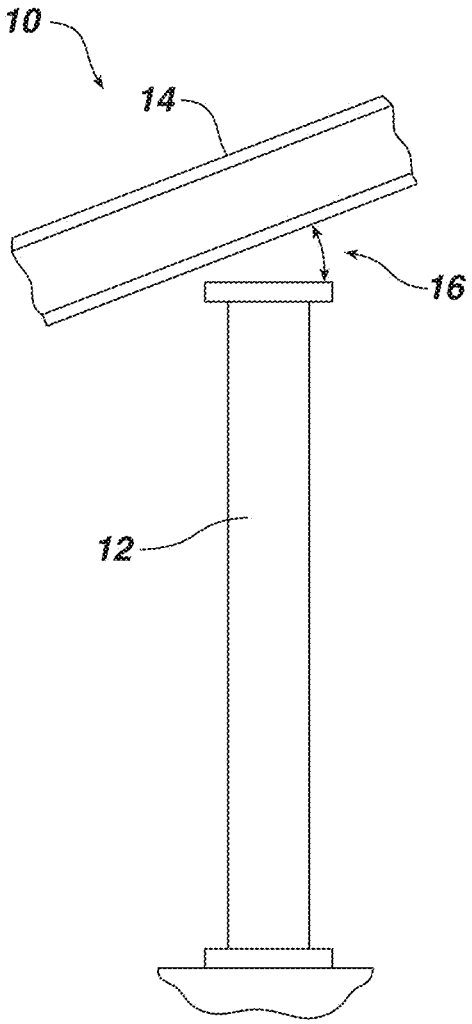
FIG. 1 PRIOR ART
FIG. 1 is a schematic elevation view of an arrangement of a vertical support exhibiting the typical misalignment between the vertical support with a structure, for example, an overhead beam, as exemplified by the prior art.

FIG. 1 is a schematic elevation view of an arrangement 10 of a vertical support 12, for example, a column, exhibiting the typical misalignment between the vertical support with a structure 14, for example, an overhead beam, as exemplified by the prior art. Only a portion of the structure 14 is shown in FIG. 1. As shown in FIG. 1, due to the orientation of the beam 14 and the orientation of column 12, for example, substantially "plumb," at least some misalignment 16 is present between the mating surface of column 12 and the mating surface of structure 14. The misalignment 16 shown in FIG. 1 is somewhat exaggerated in order to facilitate illustration of the disadvantages of the prior art over which aspects of the present invention are an improvement.

Due to this misalignment 16, care must be taken to either somehow re-orient column 12, if possible, and/or fashion an interface, for example, a weldment of plates, gussets, and/or shims, that can be inserted between the mating surfaces to ensure proper structural support of the structure 14 by the support 12. As is typical, due to the broad variation of mating surfaces of supports 12 and structures 14, when more than one interface is required, each fabricated interface structure must be uniquely tailored to the specific installation.

Figure 2:
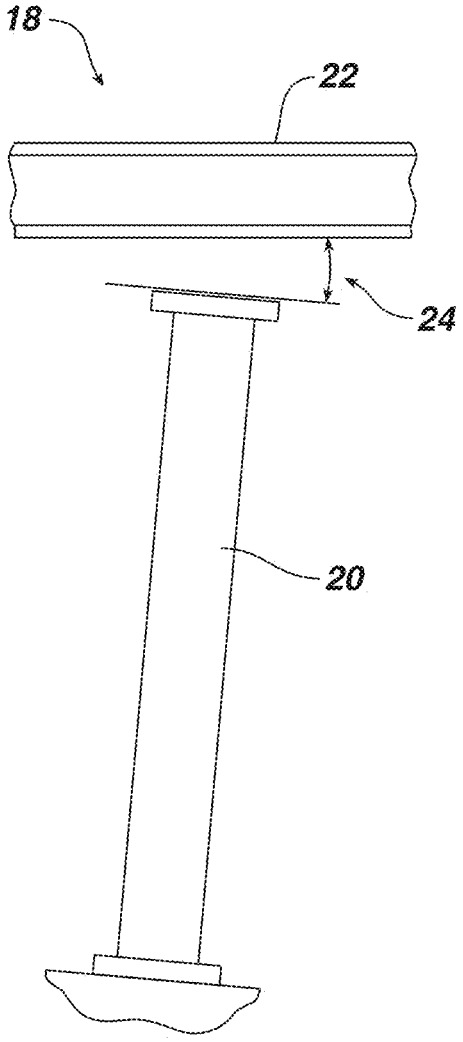
FIG. 2 PRIOR ART
FIG. 2 is a schematic elevation view of another arrangement of a vertical support, such as, a column, exhibiting a misalignment between the vertical support and a structure, for example, a beam, as exemplified by the prior art.

FIG. 2 is a schematic elevation view of another arrangement 18 of a vertical support 20, such as, a column, exhibiting a similar misalignment between support 20 and a structure 22, for example, a bridge overpass, as exemplified by the prior art. Only a portion of the structure 22 is shown in FIG. 2. As shown in FIG. 2, due to the orientation of the structure 22, for example, substantially level, and the orientation of support 20, for example, substantially "not plumb," at least some misalignment 24 between the mating surface of vertical support 20 and the mating surface of structure 22 may occur. Again, the misalignment 24 shown in FIG. 2 is somewhat exaggerated in order to facilitate illustration of the disadvantages of the prior art over which aspects of the present invention are an improvement. Again, due to this misalignment 24, some form of interface, for example, a weldment or bolted assembly, must typically be provided between the mating surfaces to ensure proper structural support of the structure 22 by the support 20.

Figure 3:
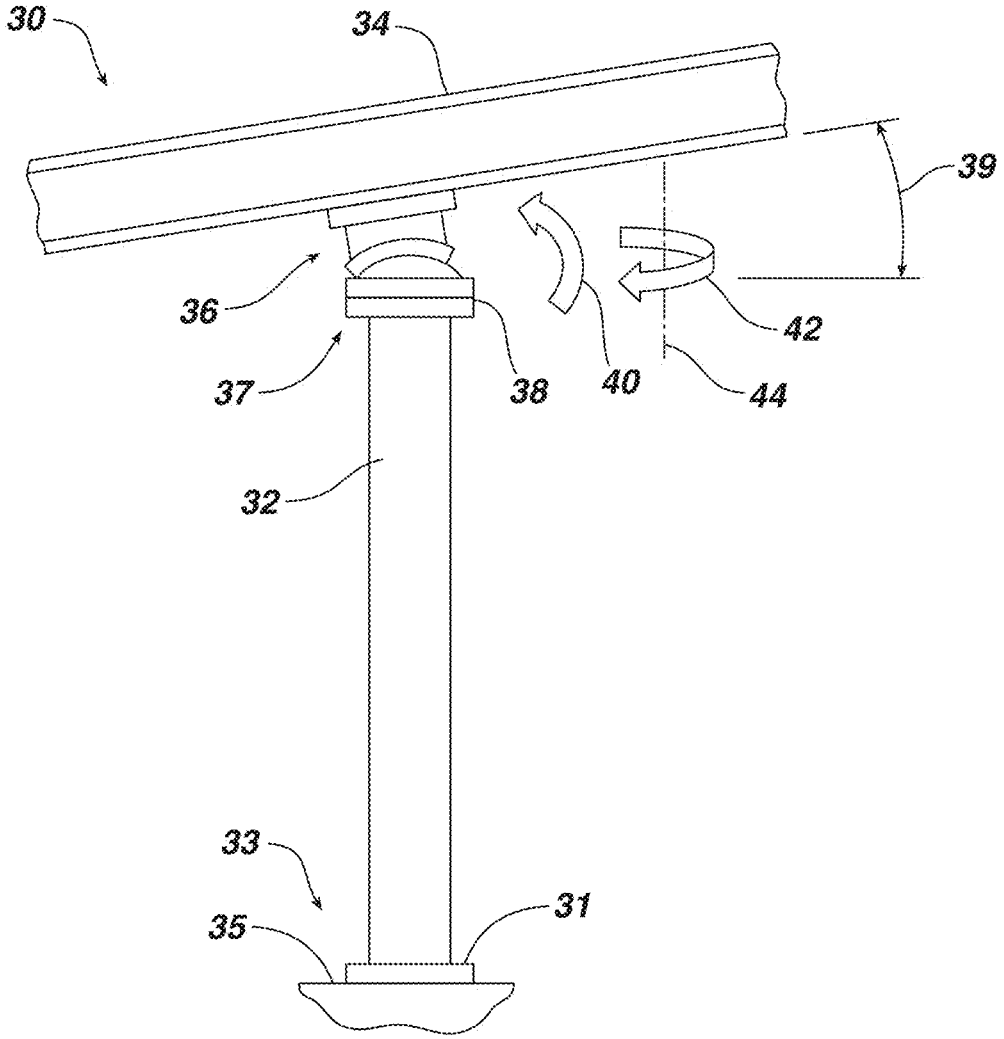
FIG. 3 is a schematic elevation view of an engagement of a vertical support with a structure being supported having a support-to-structure interface device according to an aspect of the invention.

FIG. 3 is a schematic elevation view of an arrangement 30 of the engagement of support 32, for example, a vertical column, with a structure 34, for example, a beam, having a support-to-structure interface device 36 according to an aspect of the invention. As shown, according to aspects of the invention, vertical support, or column, 32 may be an elongated structure having a first or lower end 33 having a mounting flange 31 mounted to a surface 35, for example, bedrock or masonry, by mechanical fasteners (not shown); and a second or upper end 37 having a mounting flange 38 adapted to engage interface device 36, for example, with mechanical fasteners (not shown). Though shown substantially plumb or vertical in FIG. 3, in one aspect of the invention, vertical support 32 may not be plumb, but may be non-plumb or tilted, for example, as shown for vertical support 20 in FIG. 2.

According to aspects of the invention, should the mating surface of upper mounting flange 38 of vertical support 32 and the mating surface of structure 34 not be aligned, for example, not lie in the same horizontal plane or not lie in parallel horizontal planes, a misalignment 39 between mating surfaces may occur. According to an aspect of the invention, this misalignment 39 can be addressed by installing the support-to-structure interface device 36 to properly engage the mating surfaces. For example, when the mating surface of structure 34 and the mating surface of mounting flange 38 of support 32 do not lie in parallel planes and are characterized by misalignment 39, interface device 36 may be mounted between support 32 and structure 34 and provide structural engagement between the mating surfaces. Again, the misalignment 39 shown in FIG. 3 is somewhat exaggerated in order to facilitate illustration of aspects of the present invention. In addition, though misalignment 39 is shown as a misalignment about one horizontal axis for ease of illustration, according to aspects of the invention, misalignment 39 may be present about two or more axes, for example, two or more horizontal axes, or even 3 axes, such as, 3 orthogonal axes, and misalignment 39 may be addressed using aspects of the invention. In one aspect, interface device 36 may be mounted between upper mounting flange 38 of support 32 and structure 34 and provide structural engagement between the mating surfaces. According to other aspects of the invention, though mis-aligned, interface device 36 can ensure proper structural support of the structure 34 by the support 32.

As also shown in FIG. 3, in one aspect, the engagement of the mating surfaces of the support 32 with the structure 34 with the interface device 36 may be rotationally variable, or "swivel," in at least one direction 40 or 42, but typically may be rotationally variable in at least two directions 40 and 42. As shown in FIG. 3, the variation in the rotational direction 40 may be about a horizontal axis, for example, about a horizontal axis directed substantially perpendicular to the axis of elongation of vertical support 32. In another aspect, the variation in the rotational direction 40 may be about a horizontal axis directed out of the surface of the page of FIG. 3 and/or about a horizontal axis directed substantially parallel to the surface of the page of FIG. 3, or any other horizonal axis between those horizontal axes. As also shown in FIG. 3, the variation in the rotational direction 42 may be about any vertical axis, for example, about a vertical axis 44 substantially parallel to the direction of elongation of support 32 and/or about any other substantially vertical axis.

In the aspect of the invention shown in FIG. 3, interface device 36 is shown in one aspect of the invention where the structure being supported is a beam, for example, a wide-flange beam; however, according to aspects of the invention interface device 36 is not limited to supporting beams but may be employed to support any structure, for example, any overhead structure, for instance, along a substantially vertical axis. However, according to aspects of the invention, interface device 36 may be used to support or retain a substantially vertical structure along a substantially horizontal axis. For example, interface device 36 may be used with a horizontal or angled support or strut for retaining a plate or a wall, for instance, to support a substantially vertical plate retaining dirt or sand during an excavation.

In addition, in the aspect of the invention shown in FIG. 3, vertical support or column 32 is shown in one aspect of the invention where the support 32 providing the vertical support is an elongated vertical column, for example, a hollow metal column. However, according to aspects of the invention, interface device 36 is not limited to being used with elongated columns 32, but may be employed to engage any vertical support 32 requiring alignment with the mating surface of the structure 34 being supported. For example, according to aspects of the invention, interface device 36 may be used with any vertical or non-vertical compression member, for example, a rod, a pillar, a post, a strut, a column (concrete or wooden), or a pipe (metal or plastic), among other compression members. In addition, vertical support 32 may be hollow or solid, and may have a circular, elliptical, or polygonal cross section, for example, a square, rectangular, or octagonal cross section.

Figure 4:
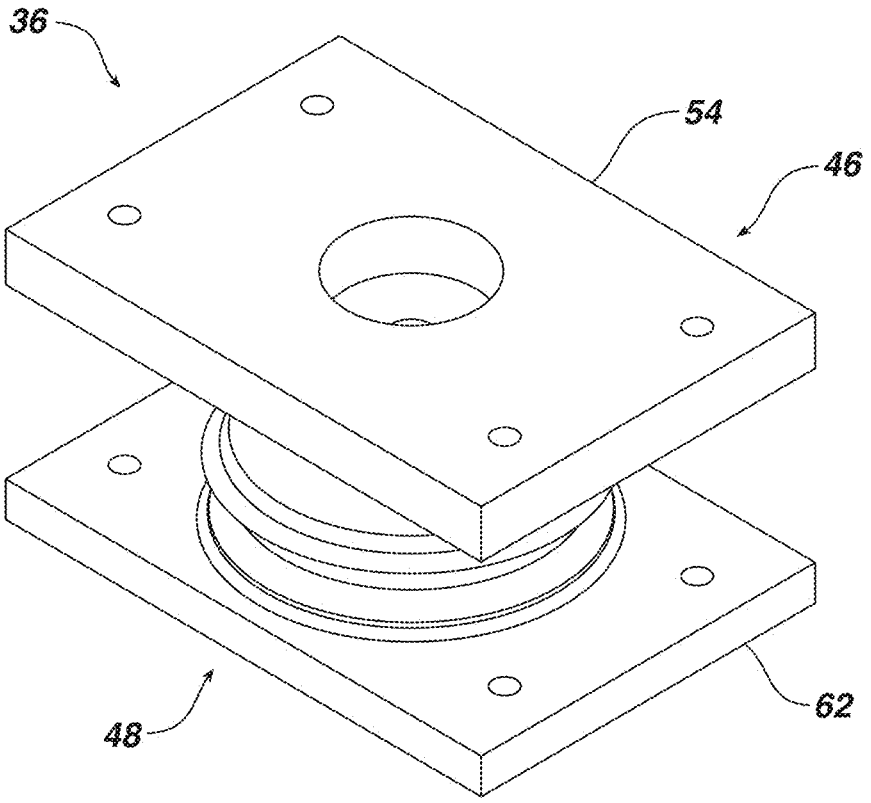
FIG. 4 is a perspective view of the support-to-structure interface device shown in FIG. 3.
Figure 5:
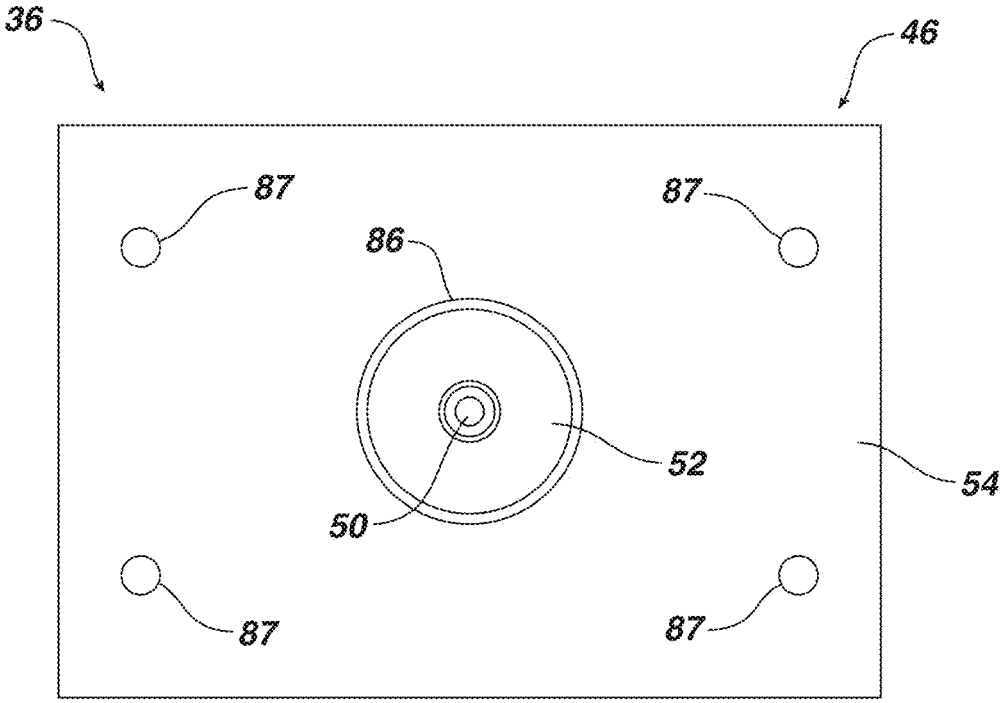
FIG. 5 is a top plan view of the interface device shown in FIG. 4.
Figure 6:
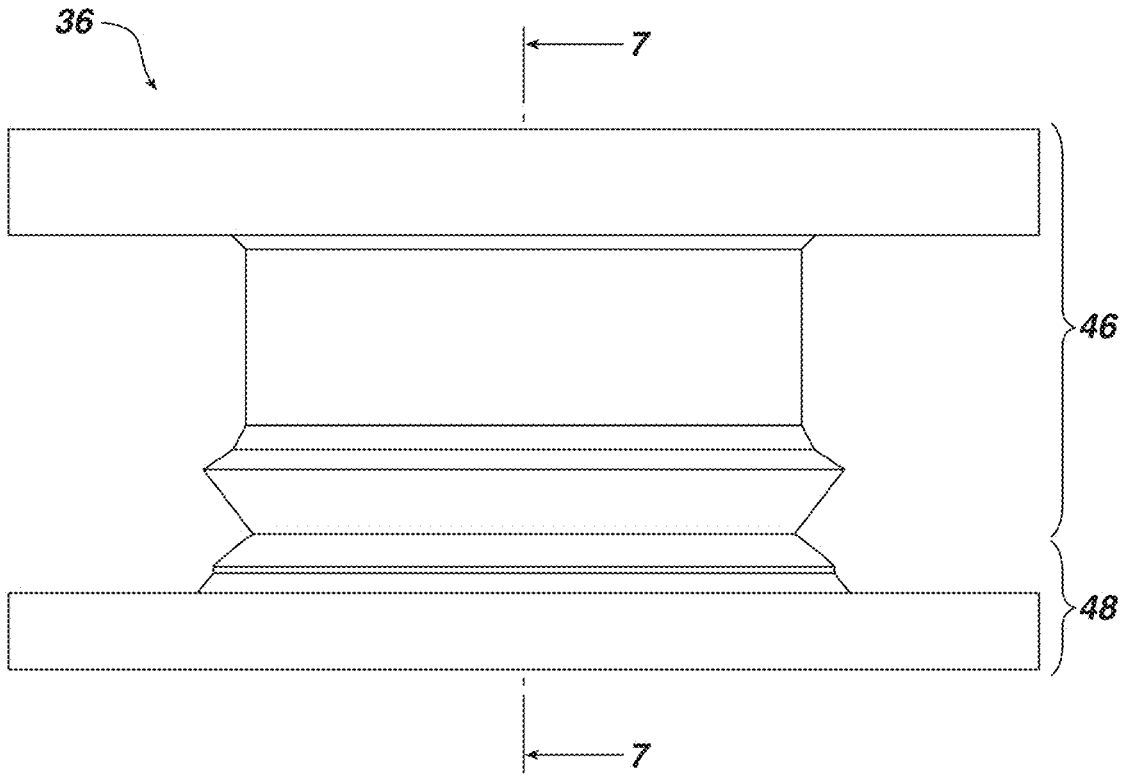
FIG. 6 is a front elevation view of the interface device shown in FIG. 4, the rear elevation view being a mirror image thereof.
Figure 7:
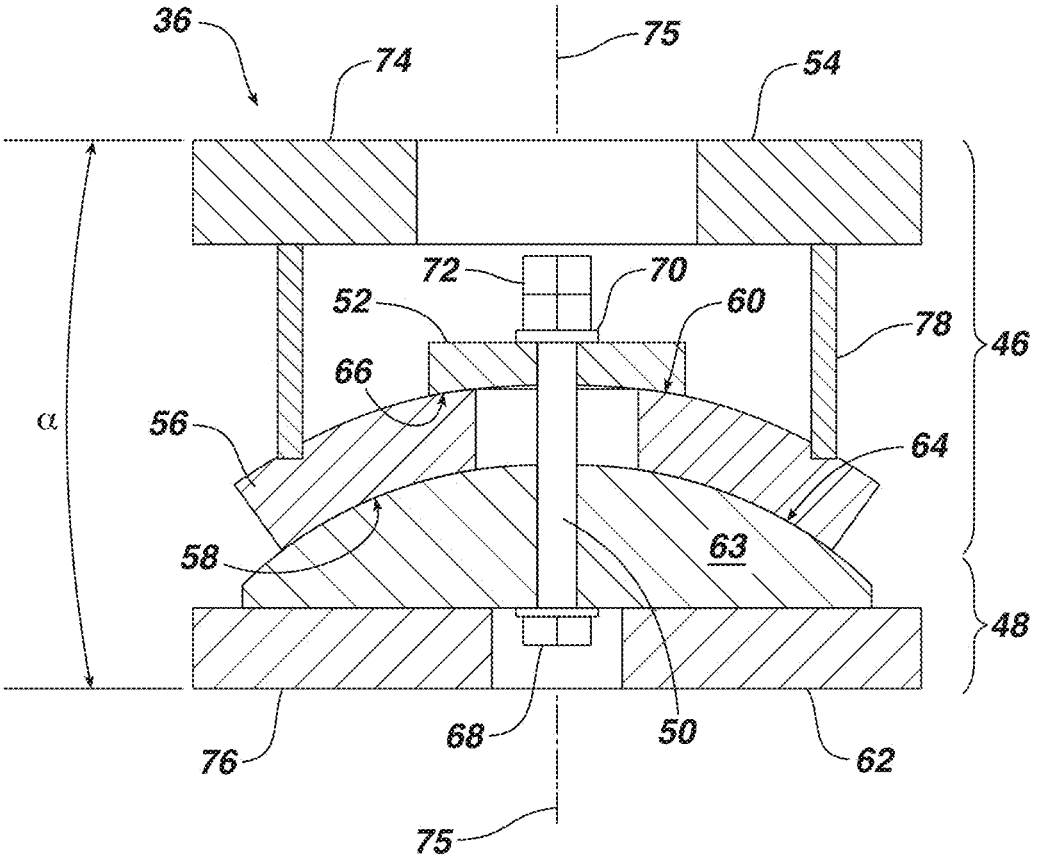
FIG. 7 is a cross-sectional view of the interface device shown in FIG. 6, as viewed along section lines 7-7 shown in FIG. 6.

FIG. 4 is a perspective view of the support-to-structure interface device 36 shown in FIG. 3. FIG. 5 is a top plan view of the interface device 36 shown in FIG. 4, and FIG. 6 is a front elevation view of the interface device 36 shown in FIG. 4, the rear elevation view being a mirror image thereof. FIG. 7 is a cross-sectional view of interface device 36 shown in FIG. 6, as viewed along section lines 7-7 shown in FIG. 6.

As shown in FIGS. 4 through 7, support-to-structure interface device 36 includes a top assembly 46 and a bottom assembly 48 connected to the top assembly by a fastener 50 and a retaining ring 52. As shown most clearly in FIG. 7, top assembly 46 includes a top plate or a top mounting plate 54 adapted to engage a structure (not shown), for example, an overhead beam, and a bearing ring 56 mounted to the top plate 54. According to aspects of the invention, the bearing ring 56 includes a first radiused bearing surface 58 and a second radiused bearing surface 60, opposite the first radiused bearing surface 58. Details of one top assembly 46 are provided in FIGS. 8, 9, and 10 and their descriptions below.

As also shown most clearly in FIG. 7, the bottom assembly 48 includes a bottom plate or bottom mounting plate 62 adapted to engage a vertical support (not shown), for example, a column or post, and a third radiused bearing surface 64. According to aspects of the invention, the third radiused bearing surface 64 of bottom assembly 48 is adapted and shaped to contact, for example, slidably contact, the first radiused bearing surface 58 of the top assembly 46. In one aspect, the bearing surface 64 may be provided by a "bearing dome" 63 of bottom assembly 48. Details of one bottom assembly 48 are provided in FIGS. 11, 12, and 13 and their descriptions below.

The retaining ring 52 of interface device 36 includes a radiused bearing surface, or a fourth radiused bearing surface, 66. The fourth radiused bearing surface 66 is adapted and shaped to contact, for example, slidably contact, the second bearing surface 60 of the top assembly 46. Details of one retaining ring 52 are provided in FIGS. 14, 15, and 16 and their descriptions below.

As shown in FIG. 7, the fastener 50, for example, a bolt 68, one or more washers 70, and one or more nuts 72, is adapted to retain the top assembly 46 on the bottom assembly 48, for example, to substantially retain or secure top assembly 46 to bottom assembly 48. However, according to aspects of the invention, the retention, or "tightness," of the top assembly 46 to the bottom assembly 48 may vary, for example, the one or more nuts 72 may be at least partially loosened to allow relative movement of the top assembly 46 to the bottom assembly 48. Bolt 68 may be an ASTM A325 bolt, for example, a ⅞-inch diameter ASTM A325 bolt, or its equivalent.

As shown in FIG. 7, in one aspect, the top plate 54 of top assembly 46 may have a contacting surface 74 adapted to contact the surface of the structure being supported (not shown) and bottom plate 62 of bottom assembly 48 may have a contacting surface 76 adapted to contact the surface of the vertical support (not shown), for example, a column. According to aspects of the invention, the relative movement of the top assembly 46 with respect to the bottom assembly 48 may be used to vary the alignment of the plane of the contact surface 74 of the top plate 54 with respect to the plane of the contact surface 76 of the bottom plate 62 to vary the angle α between contact surface 74 and contact surface 76. The alignment angle α may range from +(plus) 20 degrees to −(minus) 20 degrees, but may typically vary from +10 degrees to −10 degrees, for example, +/−5 degrees. Though in FIG. 7, the axis of rotation of the alignment angle α is shown directed substantially perpendicular to the vertical axis 75 of interface device 36 or shown directed substantially perpendicular to the page of FIG. 7, according to aspects of the invention, the axis of rotation of the alignment angle α may be directed along any radial-directed axis, for example, about any axis directed substantially perpendicular to the axis of elongation of fastener 50.

Figure 8:
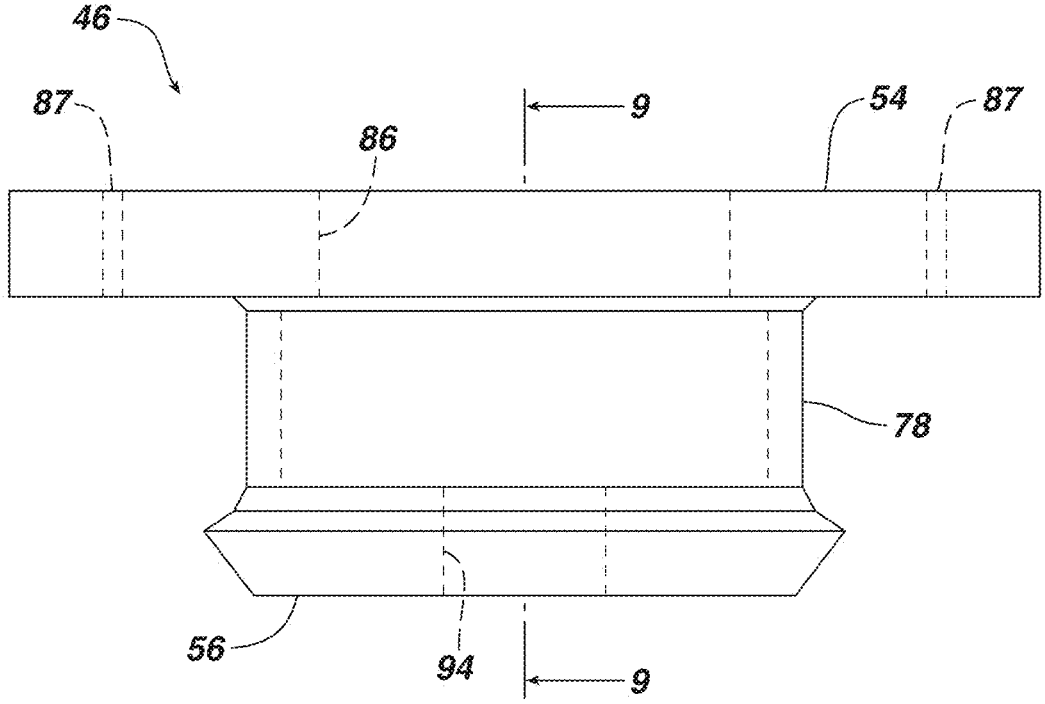
FIG. 8 is a front elevation view of the top assembly of the interface device shown in FIG. 4, the rear elevation view being a mirror image thereof.
Figure 9:
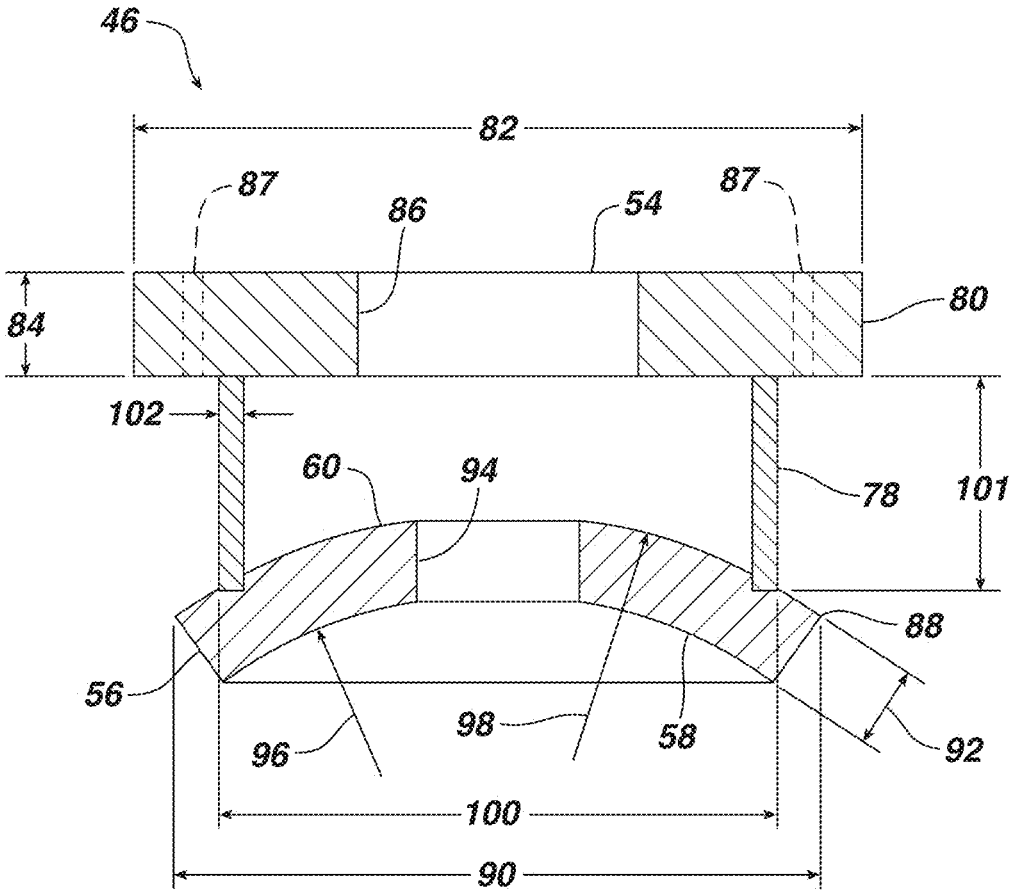
FIG. 9 is a cross-sectional view of the top assembly shown in FIG. 8, as viewed along section lines 9-9 shown in FIG. 8.
Figure 10:
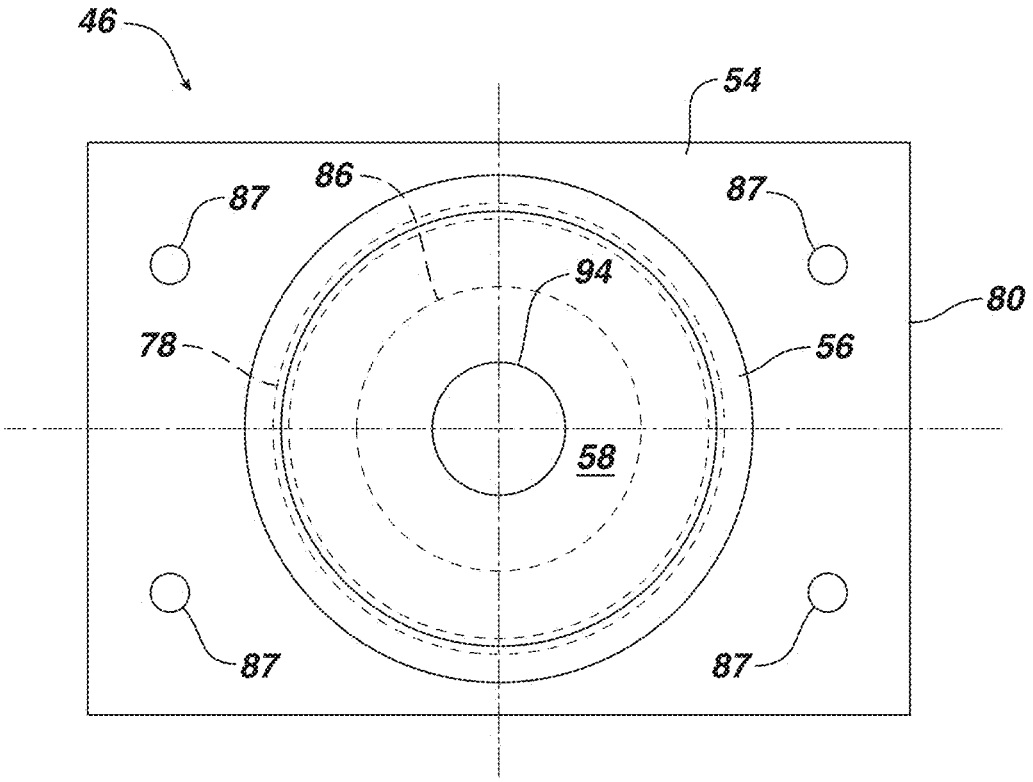
FIG. 10 is a bottom view of the top assembly of the interface device shown in FIG. 8.

FIG. 8 is a front elevation view of the top assembly 46 of the interface device 36 shown in FIG. 4, the rear elevation view being a mirror image thereof. FIG. 9 is a cross-sectional view of the top assembly 46 shown in FIG. 8, as viewed along section lines 9-9 shown in FIG. 8. FIG. 10 is a bottom view of the top assembly 46 shown in FIG. 8. As shown in FIGS. 8, 9, and 10, top assembly 46 includes a top plate 54 and a bearing ring 56, and may include a mounting cylinder or mounting collar 78. As shown in FIG. 10, top plate 54 may comprise a rectangular plate 80, but may also be circular, elliptical, or polygonal in shape. As shown in FIG. 9, top plate 54 may have an outside dimension 82, a thickness 84, a through hole 86, and mounting holes 87. Mounting holes 87 may be used to mount top assembly 46 to the intended structure (not shown), for example, with mechanical fasteners (not shown). The outside dimension 82 of plate 80 may range from 6 inches to 48 inches, but typically has an outside dimension 82 ranging from 12 inches to 24 inches. For example, plate 80 may by a 14-inch×20-inch rectangular plate. The thickness 84 of plate 80 may vary from ½ inch to 6 inches, but typically has a thickness 84 ranging from 1 inch to 3 inches. For example, plate 80 may by 2-inch-thick plate. Through hole 86 may be circular or polygonal, hole 86 is typically circular, having an inside dimension ranging from 1 inch to 12 inches, but typically has an inside dimension ranging from 3 inches to 8 inches. For example, through hole 86 may have an inside diameter of about 5½ inches. Mounting holes 87 may be circular or polygonal, but are typically circular, having an inside dimension ranging from ½ inch to 3 inches, but typically has an inside dimension ranging from ¾ inches to 1½ inches. For example, mounting holes 87 may have an inside diameter of about 15/16 inches.

According to aspects of the invention, as shown in FIGS. 8 and 9, bearing ring 56 includes a lower, or first, radiused bearing surface 58 and an upper, or second, radiused bearing surface 60. As disclosed herein, according to aspects of the invention, lower radiused bearing surface 58 is adapted and shaped to contact the radiused bearing surface, or third radiused bearing surface, 64, of bottom assembly 48, and upper radiused bearing surface 60 is adapted and shaped to contact the radiused bearing surface, or fourth radiused bearing surface, 66 of retaining ring 52.

As shown in FIG. 9, bearing ring 56 may comprise a circular plate 88, but may also be elliptical or polygonal in shape, having outside dimension 90, a thickness 92, and a through hole 94. The outside dimension 90 of plate 88 may range from 6 inches to 48 inches, but typically has an outside dimension 90 ranging from 8 inches to 16 inches. For example, plate 88 may by a 12 5/16-inch diameter circular plate. The thickness 92 of plate 88 may vary from ½ inch to 6 inches, but typically has a thickness 92 ranging from 1 inch to 3 inches. For example, plate 88 may be a 1½-inch-thick plate. Through hole 94 may be circular or polygonal, but is typically circular, having an inside dimension ranging from 1 inch to 12 inches, but typically has an inside dimension ranging from 2 inches to 6 inches. For example, through hole 94 may have an inside diameter of about 3¼ inches.

According to aspects of the invention, as shown in FIG. 9, lower, or first, bearing surface 58 and upper, or second, bearing surface 60 of bearing ring 56 are typically radiused surfaces, for example, at least partially radiused in the portion or portions of the respective surfaces that bear against their respective mating surfaces. As shown in FIG. 9, lower bearing surface 58 may have a radius 96 and upper bearing surface 60 may have a radius 98. The radiuses 96 and 98 may vary in length depending, among other things, on the size of interface device 36. In one aspect, radius 96 and radius 98 may range from 3 inches to 36 inches, but typically range from 8 inches to 16 inches. For example, in one aspect, radius 96 of lower bearing surface 58 may be 9 inches and radius 98 of upper bearing surface 60 may be 10½ inches.

In one aspect, lower, or first, bearing surface 58 and upper, or second, bearing surface 60, or at least a portion thereof, may be machined surfaces, for example, having a surface finish, for instance, a surface finish that reduces or minimizes the force of friction opposing the relative movement of bearing surface 58 and bearing surface 60 when bearing against their respective opposing bearing surfaces. In one aspect, lower bearing surface 58 and upper bearing surface 60 may have a surface finish expressed as "average roughness value (Ra)" of at least 1000 micro inches [μin.], or at least 500 μin. or at least 250 μin. For example, in one aspect, lower bearing surface 58 may have an average roughness value of 250 μin. and upper bearing surface 60 may have an average roughness value of 500 μin.

In one aspect, in order to reduce or minimize the force of friction opposing the relative movement against their respective opposing bearing surfaces, lower bearing surface 58 and upper bearing surface 60 may be treated or coated with a friction reducing material. For example, in one aspect, lower bearing surface 58 and upper bearing surface 60 may be treated with a lubricant, for example, a petroleum-based lubricant, such as, an oil or a grease. In one aspect, at least one of lower bearing surface 58 and upper bearing surface 60 may be provided with "grease grooves," for example, one or more radially and/or circumferentially directed grooves, channels, or recesses in these surfaces that can function as grease distribution passages to assist in distributing grease between the mating surfaces. In one aspect, top assembly 46 may include one or more grease distribution passages positioned and sized to introduce a grease or other lubricant to the grease grooves or channels, for example, one or more passages in bearing ring 56. In one aspect, the grease passages may be provided with grease fittings to facilitate introduction of the grease or other lubricant to the grease passages and to the grease grooves. FIGS. 18 through 23 and their descriptions provide a detailed disclosure of some lubricant groves or channels and their locations in lower bearing surface 58 and upper bearing surface 60 according to one aspect of the invention. In another aspect, lower bearing surface 58 and upper bearing surface 60 may be treated or coated with a friction-reducing material, for example, a polytetrafluoroethylene (PTFE), such as, a Dupont Teflon® PTFE, or its equivalent, or a Saint-Gobain Rulon® PTFE or its equivalent.

As shown in FIG. 9, top assembly 46 may include a mounting cylinder or mounting collar 78 positioned between top plate 54 and bearing ring 56. Mounting cylinder 78 may be provided to position or locate top plate 54 from bearing ring 56. Mounting cylinder 78 may be a hollow cylinder and provide an internal cavity, for example, for locating retaining ring 52 and fastener 50 (See FIG. 7). In one aspect, mounting cylinder 78 may be a circular cylinder, for example, a hollow circular cylinder. In other aspects, mounting cylinder 78 may be an elliptical cylinder or a polygonal cylinder, for example, a hollow square cylinder or a hollow rectangular cylinder.

Mounting cylinder 78 may have an outside dimension 100, a height 101, and a thickness 102. The outside dimension 100 of mounting cylinder 78 may range from 6 inches to 48 inches, but typically has an outside dimension 100 of ranging from 8 inches to 16 inches. For example, mounting cylinder 78 may be 10¾ inches in diameter. The height 101 of mounting cylinder 78 may vary from 2 inches to 24 inches, but typically has a height 101 ranging from 3 inches to 6 inches. For example, mounting cylinder 78 may be 4 1/16 inch in height. The thickness 102 of mounting cylinder 78 may vary from ¼ inch to 3 inches, but typically has a thickness 102 ranging from ½ inch to 1 inch. For example, mounting cylinder 78 may be ½ inch thick.

In one aspect, mounting cylinder 78 may be omitted, for example, where top plate 54 may be mounted directly to bearing ring 56. In another aspect, mounting cylinder 78 may be omitted and top plate 54 and bearing ring 55 may be provided as a single integral component, for example, formed from a single piece, for example, machined, molded, or forged as a single component.

Top plate 54, bearing ring 56, and mounting cylinder 78 may be fabricated from a metal, from a plastic, or even from wood, but are typically fabricated from a metal. When metallic, top plate 54, bearing ring 56, and mounting cylinder 78 may be made from aluminum, steel, stainless steel, or titanium. In one aspect, top plate 54, bearing ring 56, and mounting cylinder 78 are fabricated from a steel, for example, from ASTM A572 steel, for example, an ASTM A572 Grade 50 steel, or its equivalent. Top plate 54, bearing ring 56, and mounting cylinder 78 may be attached by welding, for example, with one or more filet welds provided by shielded metal are welding (SMAW) or a similar welding technique.

Figure 11:
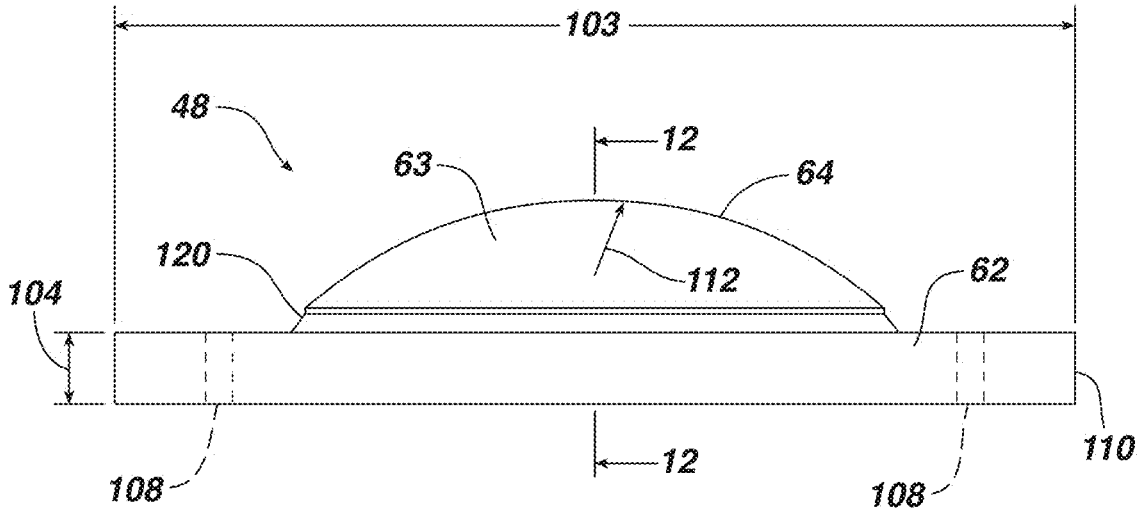
FIG. 11 is a front elevation view of the bottom assembly of the interface device shown in FIG. 4, the rear elevation view being a mirror image thereof.
Figure 12:
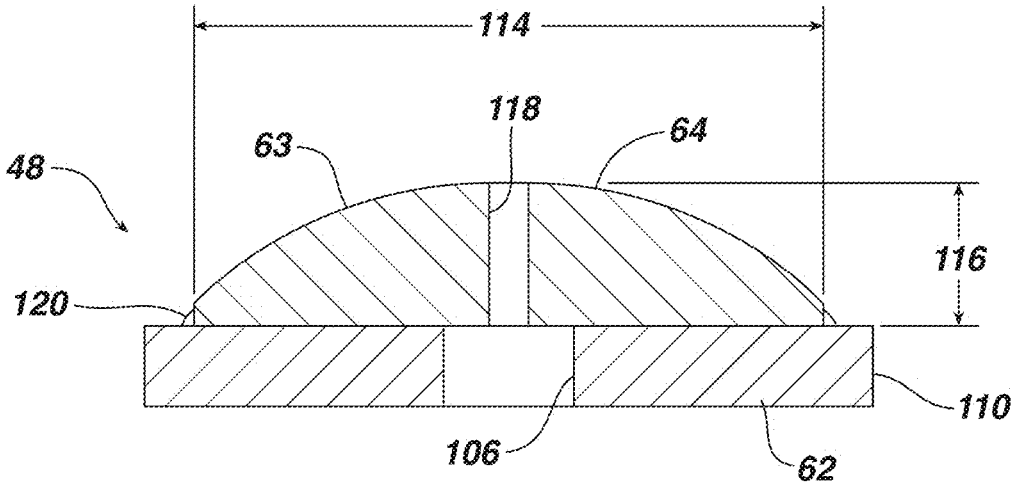
FIG. 12 is a cross-sectional view of the bottom assembly shown in FIG. 11, as viewed along section lines 12-12 shown in FIG. 11.
Figure 13:
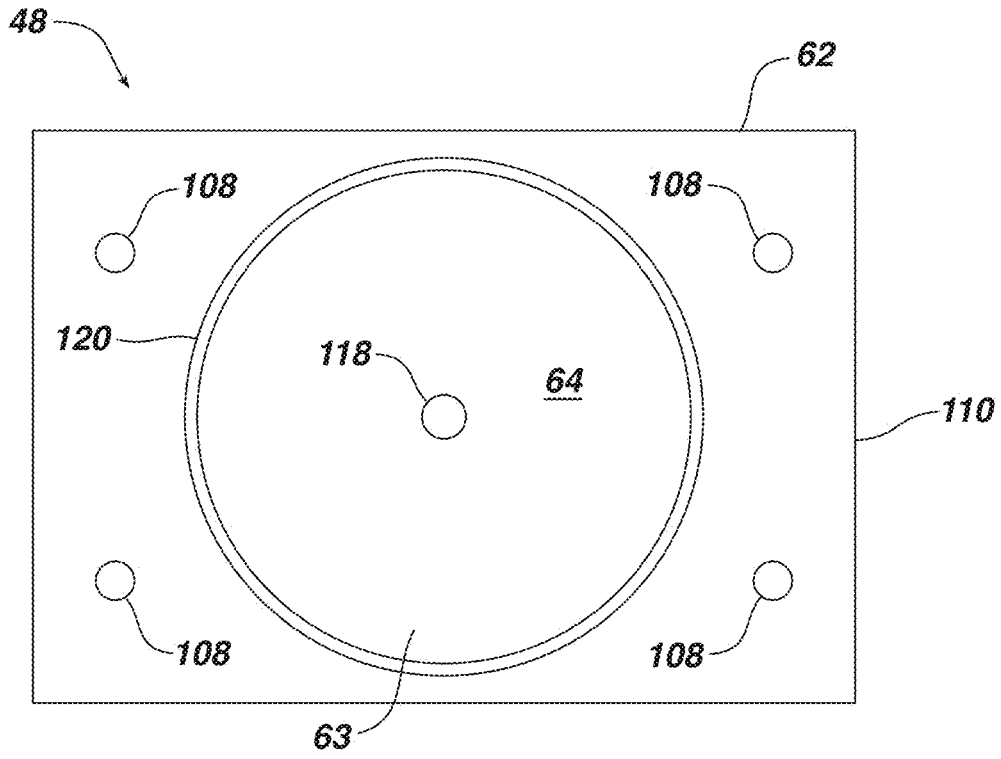
FIG. 13 is a top plan view of the bottom assembly shown in FIG. 11.

FIG. 11 is a front elevation view of the bottom assembly 48 of the interface device 36 shown in FIG. 7, the rear elevation view being a mirror image thereof. FIG. 12 is a cross-sectional view of the bottom assembly 48 shown in FIG. 11, as viewed along section lines 12-12 shown in FIG. 11. FIG. 13 is a top plan view of the bottom assembly 48 shown in FIG. 11. As shown in FIGS. 11, 12, and 13, bottom assembly 48 includes a plate or bottom plate 62 and a bearing structure or bearing dome 63 mounted to bottom plate 62. As disclosed herein, bearing structure 63 includes a radiused bearing surface, or a third radiused bearing surface, 64 adapted and shaped to contact the radiused bearing surface, or first radiused bearing surface, 58 of top assembly 46.

As shown in FIGS. 11, 12, and 13, bottom plate 62 may comprise a rectangular plate no, but may also be a circular, an elliptical, or a polygonal plate, having an outside dimension 103, a thickness 104, a through hole 106, and mounting holes 108. Mounting holes 108 may be used to mount bottom assembly 48 to the intended vertical support (not shown), for example, with mechanical fasteners (not shown). As shown must clearly in FIG. 7, through hole 106 in plate no may be provided to accommodate the fastener 50, for example, to recess the bolt head of bolt 68. The outside dimension 103 of plate 110 may range from 6 inches to 48 inches, but typically has an outside dimension 102 of ranging from 12 inches to 24 inches. For example, plate no may by a 14-inch×20-inch rectangular plate. The thickness 104 of plate 110 may vary from ½ inch to 6 inches, but typically thickness 104 ranges from 1 inch to 3 inches. For example, plate 80 may by 1½-inch-thick plate. Through hole 106 in plate 110 may be circular or polygonal, but is typically circular, having an inside dimension ranging from 1 inch to 12 inches, but typically has an inside dimension ranging from 2 inches to 8 inches. For example, through hole 106 may have an inside diameter of about 2½ inches. Mounting holes 108 may be circular or polygonal, but are typically circular, having an inside dimension ranging from ½ inch to 3 inches but typically have an inside dimension ranging from ¾ inch to 1½ inches. For example, mounting holes 108 may have an inside diameter of about 15/16 inches.

According to aspects of the invention, as shown in FIGS. 11, 12, and 13, bearing structure or bearing dome 63 includes a radiused bearing surface, or a third radiused bearing surface, 64. As disclosed herein, according to aspects of the invention radiused bearing surface 64 is adapted and shaped to contact the radiused bearing surface, or first radiused bearing surface 58 of top assembly 46.

As shown in FIGS. 11, 12, and 13, bearing structure or bearing dome 63 may comprise a spherical cap, a hemispherical dome, or a spherical dome having a radius 112 (FIG. 11), an outside dimension or diameter 114, a thickness or height 116, and a through hole 118. As shown must clearly in FIG. 7, through hole 118 may be provided to accommodate the passage of fastener 50. The outside dimension or diameter 114 of bearing dome 63 may range from 6 inches to 48 inches, but typically has an outside dimension 114 ranging from 8 inches to 16 inches. For example, bearing dome 63 may have a diameter 114 of 12 inches. The thickness or height 116 of bearing dome 63 may vary from ½ inch to 12 inches, but typically has a thickness or height 116 ranging from 1 inch to 6 inches. For example, bearing dome 63 may have a thickness or height 116 of 2¾ inches. Through hole 118 may be circular or polygonal, but is typically circular, having an inside dimension ranging from 1 inch to 12 inches but typically have an inside dimension ranging from 1 inch to 3 inches. For example, through hole 118 may have an inside diameter of 15/16 inches.

According to aspects of the invention, as shown in FIGS. 11, 12, and 13, bearing surface 64 of bearing dome 63 is typically a radiused surface, for example, at least partially radiused in the portion or portions of the surface 64 that bears against the respective mating surface. As shown in FIG. 11, bearing surface 64 may have a radius 112. The radius 112 may vary in length depending, among other things, on the size of interface device 36. In one aspect, radius 112 may range from 3 inches to 36 inches, but typically ranges from 8 inches to 16 inches. For example, bearing dome 63 may have a radius 112 of 9 inches.

In one aspect, bearing surface 64 of bearing dome 63 of bottom assembly 48, or at least a portion thereof, may be a machined surface, for example, having a surface finish, for instance, a surface finish that reduces or minimizes the force of friction opposing the relative movement of the mating surface bearing against bearing surface 64. In one aspect, bearing surface 64 may have a surface finish expressed as "average roughness value (Ra)" of at least 1000 μin., or at least 500 μin. or at least 250 μin. For example, in one aspect, bearing surface 64 may have an average roughness value of 250 μin.

In one aspect, in order to reduce or minimize the force of friction opposing the relative movement against their respective opposing bearing surfaces, bearing surface 64 of bearing dome 63 may be treated or coated with a friction reducing material. For example, in one aspect, bearing surface 64 may be treated with a lubricant, for example, a petroleum-based lubricant, such as, an oil or a grease. In one aspect, bearing surface 64 of bearing dome 63 may be provided with "grease grooves," for example, one or more radially and/or circumferentially directed grooves or recesses in bearing surface 64 that can function as grease distribution passages to assist in distributing grease or oil between the mating surfaces. In one aspect, bottom assembly 48 may include one or more grease distribution passages positioned and sized to introduce a grease or other lubricant to the grease grooves, for example, one or more passages in bearing dome 63. In one aspect, the grease passages may be provided with grease fittings to facilitate introduction of the grease other lubricant to the grease passages and to the grease grooves. FIGS. 18 through 26 and their descriptions provide a detailed disclosure of some lubricant groves or channels and their locations in bearing surface 64 of bearing dome 63 according to one aspect of the invention. In another aspect, bearing surface 64 may be treated or coated with a friction-reducing material, for example, a PTFE, such as, a Dupont Teflon® PTFE, or its equivalent, or a Saint-Gobain Rulon® PTFE or its equivalent. In one aspect, bearing dome 63 may be fabricated entirely from a PTFE-containing material.

In one aspect, bottom plate 62 and bearing dome 63 may be provided as a single integral component, for example, formed from a single piece, for example, machined, molded, or forged as a single component. However, bottom plate 62 and bearing dome 63 may be provided as separate components and then mated, for example, with an adhesive, with mechanical fasteners, or with welding. As shown in FIGS. 10, 11, and 12, in one aspect, bearing dome 63 may be connected to bottom plate 62 by one or more welds 120, for example, with one or more filet welds provided by SMAW or a similar welding technique.

Bottom plate 62 and bearing dome 63 may be fabricated from a metal, from a plastic, or even from wood, but are typically fabricated from a metal. When metallic, bottom plate 62 and bearing dome 63 may be made from aluminum, steel, stainless steel, or titanium. In one aspect, bottom plate 62 and bearing dome 63 are fabricated from a steel, for example, from ASTM A572 steel, such as, an ASTM A572 Grade 50 steel, or its equivalent.

Figure 14:
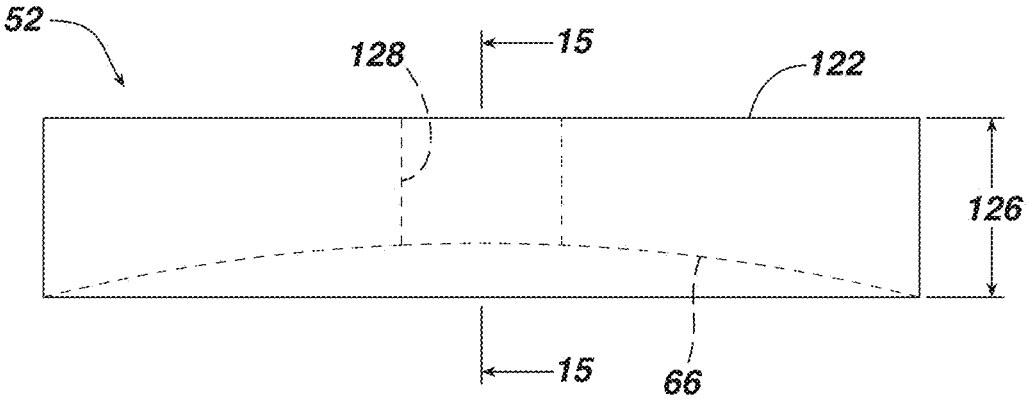
FIG. 14 is a front elevation view of the retaining ring of the interface device shown in FIG. 7, the rear elevation view being a mirror image thereof.
Figure 16:
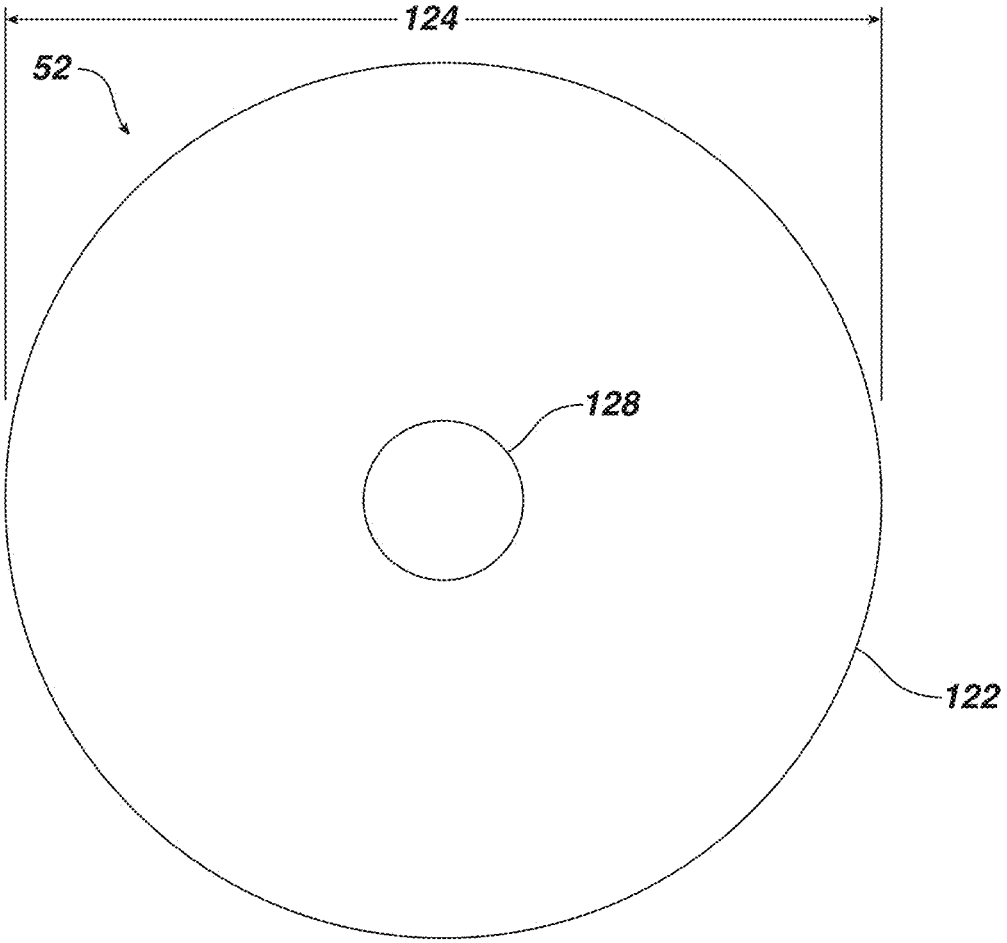
FIG. 16 is a top plan view of the retaining ring shown in FIG. 14.
Figure 15:
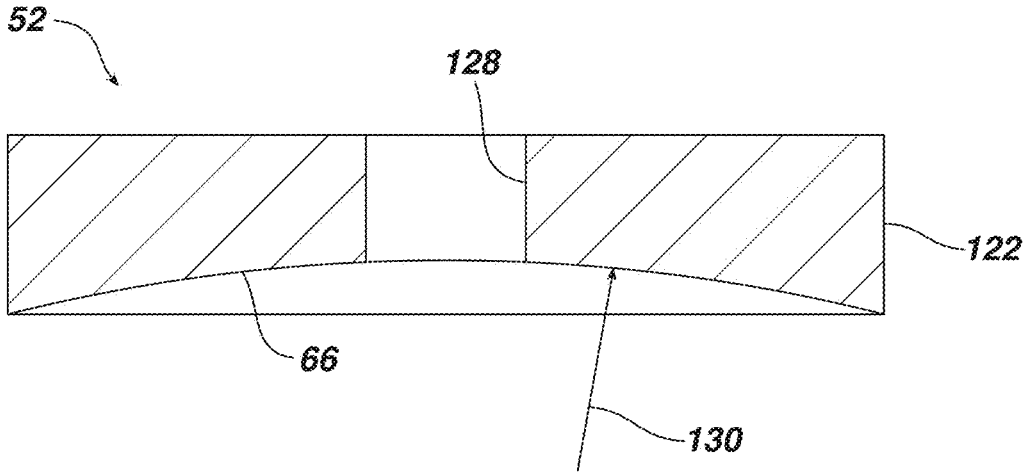
FIG. 15 is a cross-sectional view of the retaining ring shown in FIG. 14, as viewed along section lines 15-15 shown in FIG. 14.

FIG. 14 is a front elevation view of the retaining ring 52 of the interface device 36 shown in FIG. 7, the rear elevation view being a mirror image thereof. FIG. 15 is a cross-sectional view of the retaining ring 52 shown in FIG. 14, as viewed along section lines 15-15 shown in FIG. 14. FIG. 16 is a top plan view of the retaining ring 52 shown in FIG. 14. As shown in FIGS. 14, 15, and 16, retaining ring 52 includes a radiused bearing surface, or a fourth radiused bearing surface, 66. As disclosed herein, fourth bearing surface 66 is adapted and shaped to contact the upper radiused bearing surface, or second radiused bearing surface, 60 of bearing ring 56 of top assembly 46.

As shown in FIGS. 14, 15, and 16, retaining ring 52 may comprise a circular plate 122, but may also be elliptical or polygonal (for example, square or hexagon) in shape, having outside dimension or diameter 124, a thickness 126, and a through hole 128. As shown must clearly in FIG. 7, through hole 128 may be provided to accommodate the fastener 50. The outside dimension 124 of plate 122 may range from 2 inches to 24 inches, but typically has an outside dimension 124 ranging from 3 inches to 7 inches. For example, plate 110 may be a 5 inch-diameter circular plate. The thickness 126 of plate 122 may vary from ½ inch to 6 inches, but typically thickness 126 ranges from 1 inch to 3 inches. For example, plate 122 may be a 1-inch-thick circular plate. Through hole 128 may be circular or polygonal, but is typically circular, having an inside dimension ranging from ½ inch to 3 inches, but typically has an inside dimension ranging from ¾ inch to 1½ inches. For example, through hole 128 may have an inside diameter of 15/16 inches.

According to aspects of the invention, as shown in FIGS. 14, 15, and 16, bearing surface 66 of retaining ring 52 is typically a radiused surface, for example, at least partially radiused in the portion or portions of the surface 66 that bear against its respective mating surface. As shown in FIG. 15, bearing surface 66 may have a radius 130. The radius 130 may vary in length depending, among other things, on the size of interface device 36. In one aspect, radius 130 may range from 3 inches to 36 inches, but typically ranges from 8 inches to 16 inches. For example, bearing surface 66 may have a radius 130 of 10½ inches.

In one aspect, bearing surface 66 of retaining ring 52, or at least a portion thereof, may be a machined surface, for example, having a surface finish, for instance, a surface finish that reduces or minimizes the force of friction opposing the relative movement of the bearing surface against which bearing surface 66 bears, for example, bearing surface 60. In one aspect, bearing surface 66 may have a surface finish expressed as "average roughness value (Ra)" of at least 1000 μin., or at least 500 μin. or at least 250 μin. For example, in one aspect, bearing surface 64 may have an average roughness value of 500 μin.

Figure 24:
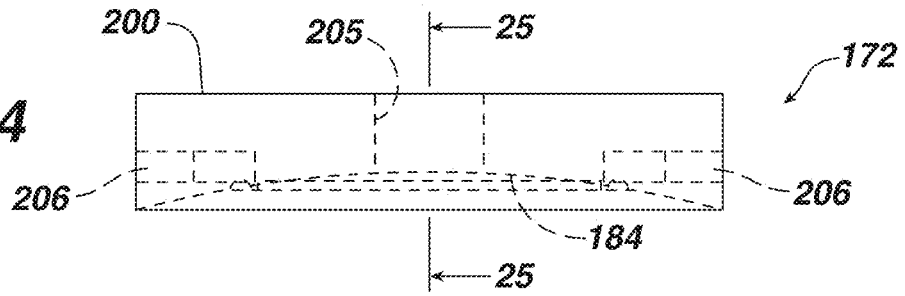
FIG. 24 is a front elevation view of the retaining ring of the interface device shown in FIG. 19, the rear elevation view being a mirror image thereof.
Figure 25:
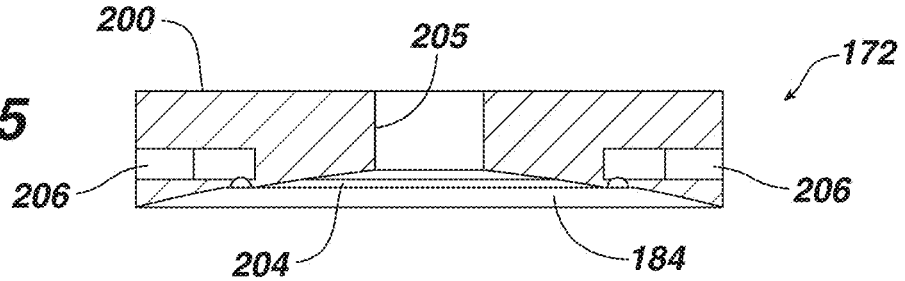
FIG. 25 is a cross-sectional view of the retaining ring shown in FIG. 24, as viewed along section lines 25-25 shown in FIG. 24.
Figure 26:
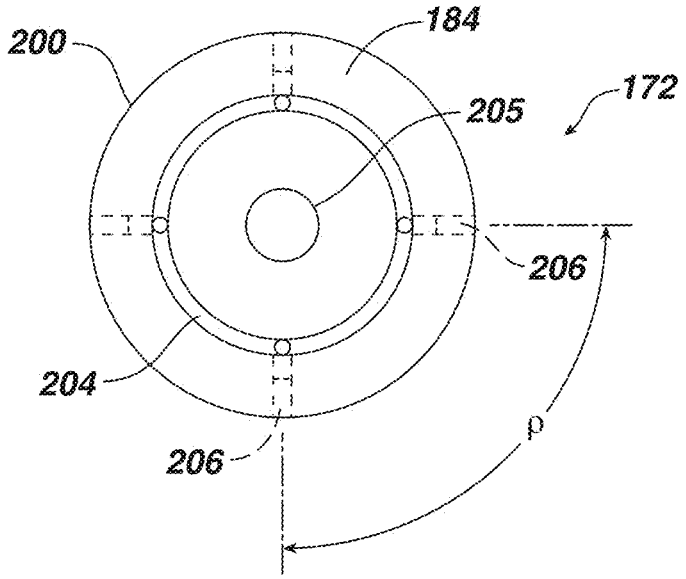
FIG. 26 is a bottom view of the retaining ring shown in FIG. 24.

In one aspect, in order to reduce or minimize the force of friction opposing the relative movement of the opposing bearing surface, bearing surface 66 of retaining ring 52 may be treated or coated with a friction reducing material. For example, in one aspect, bearing surface 66 may be treated with a lubricant, for example, a petroleum-based lubricant, such as, an oil or a grease. In one aspect, bearing surface 66 of retaining ring 52 may be provided with "grease grooves," for example, one or more radially and/or circumferentially directed grooves or recesses in bearing surface 66 that can function as grease distribution passages to assist in distributing grease between the mating surfaces. In one aspect, retaining ring 52 may include one or more grease distribution passages positioned and sized to introduce a grease or other lubricant to the grease grooves, for example, one or more passages in retaining ring 52. In one aspect, the grease passages may be provided with grease fittings to facilitate introduction of the grease other lubricant to the grease passages and to the grease grooves. FIGS. 24 through 26 and their descriptions provide a detailed disclosure of some lubricant groves or channels and their locations in bearing surface 66 of retaining ring 52 according to one aspect of the invention. In another aspect, bearing surface 66 may be treated or coated with a friction-reducing material, for example, a PTFE, such as, a Dupont Teflon® PTFE, or its equivalent, or a Saint-Gobain Rulon® PTFE, or its equivalent. In one aspect, retaining ring 52 may be fabricated entirely from a PTFE-containing material.

Retaining ring 52 may be fabricated from a metal, from a plastic, or even from a wood, but is typically fabricated from a metal. When metallic, bottom retaining ring 52 may be made from aluminum, steel, stainless steel, or titanium. In one aspect, retaining ring 52 is fabricated from a steel, for example, from ASTM A572 steel, such as, an ASTM A572 Grade 50 steel, or its equivalent.

Figure 17:
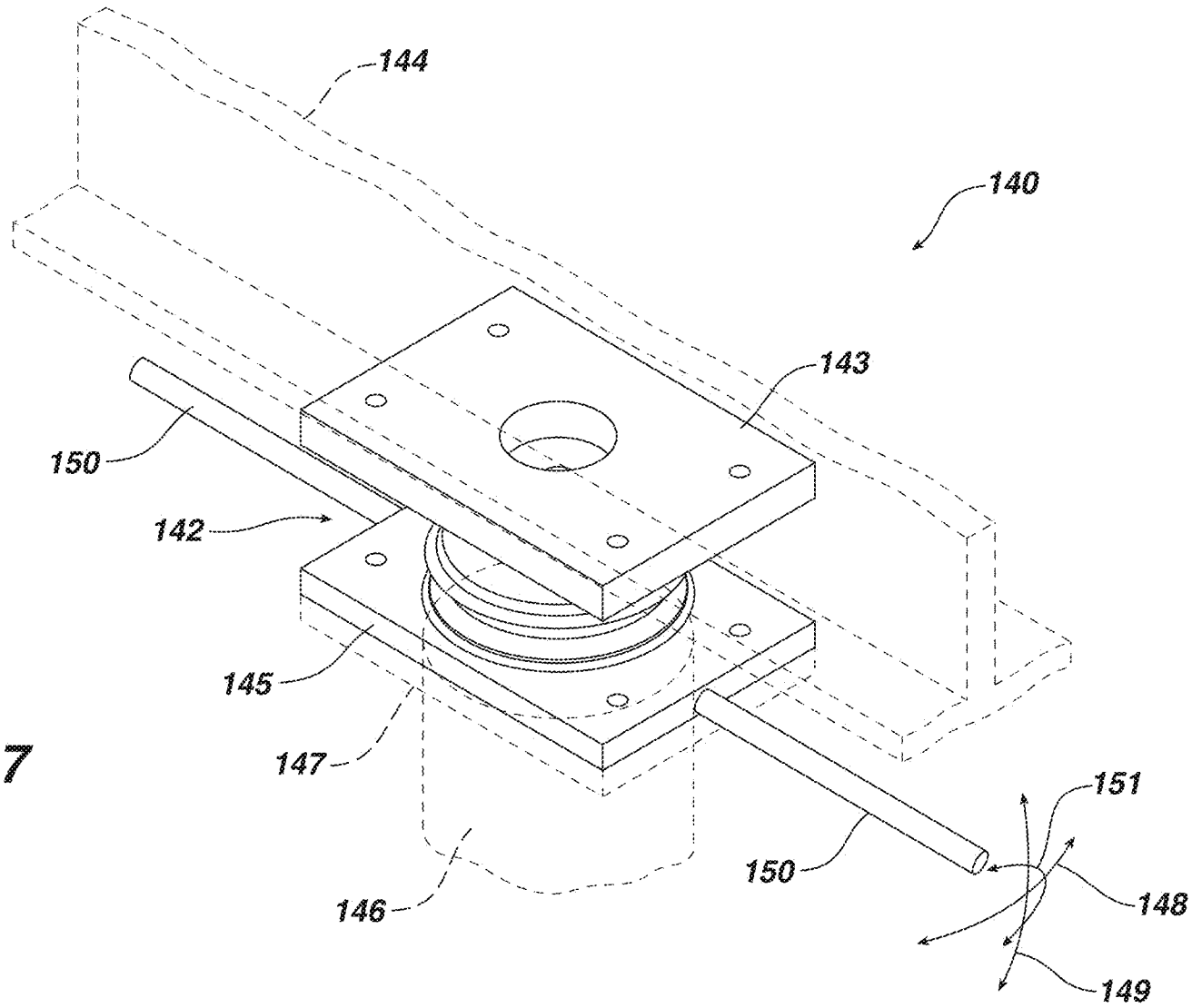
FIG. 17 is a perspective view of an arrangement of an interface device according to another aspect of the invention when mounted between a structure (shown in phantom) and a vertical support (shown in phantom).

FIG. 17 is a perspective view of an arrangement 140 of an interface device 142 according to another aspect of the invention when mounted between a structure 144 (shown in phantom) and a vertical support 146 (shown in phantom). As shown in FIG. 17, the structure 144 may be a wide-flanged beam, only a portion of which is shown in FIG. 17, and the vertical support 146 may be a circular column, only a portion of which is shown in FIG. 17. As disclosed herein, interface device 142 may be similar to, if not identical to, and have the same function as interface device 36 disclosed herein. Specifically, interface device 142 includes a top assembly 143 (for example, similar to top assembly 46 of interface device 36) and a bottom assembly 145 (for example, similar to bottom assembly 48 of interface device 36). In one aspect, top assembly 143 and bottom assembly 145 may be tethered or otherwise connected to each other by means of a cord, a rope, a wire rope, or a chain, for example, as a safety precaution and/or to prevent total disengagement of top assembly 143 and bottom assembly 145, for instance, due the failure of the connecting fastener or failure of the mounting fasteners. The tether may be mounted to top assembly 143 and bottom assembly 145 by any conventional means, for example, with mechanical hardware or welding. One tether arrangement that may be used is shown and disclosed in FIG. 27 through 31.

According to aspects of the invention, the vertical support 146 may have a top mounting plate 147 having a mounting surface that is not parallel to the bottom surface of the structure 144, for example, the bottom surface of the wide-flange beam. Accordingly, the mating surfaces of the vertical support 146 and the structure 144 deviate, for example, by the angle $\alpha$ shown in FIG. 7, where the mating surfaces do not contact sufficiently to transmit the load of the structure 144 onto the vertical support 146. As disclosed herein, interface device 142 (and interface device 36, 160, and 220) are uniquely adapted to engage the surfaces of structure 144 and vertical support 146 where vertical support 146 can properly support the load of structure 144.

According to an aspect of the invention, a method of supporting structure 144 with vertical support 146 is provided. The interface device 142 may be installed between structure 144 and vertical support 146 in any fashion depending upon the relative orientations, positions, and geometry of the mating surfaces of structure 144 and vertical support 146. In one aspect, the top assembly 143 is mounted to structure 144, for example, with mechanical fasteners, such as, nuts and bolts; and the bottom assembly 145 is mounted to vertical support 146, for example, with mechanical fasteners, such as, nuts and bolts. The order of operation of the mounting of top assembly 143 and bottom assembly 14 may vary depending, among other things, the specific orientations, and positions of the mating surfaces.

It is envisioned that, though not shown in FIG. 17, the arrangement 140 shown in FIG. 17 may include one or more intermediate mounting plates or "shims" (not shown). For example, one or more intermediate mounting plates may be provided to facilitate engagement with interface device 142 and/or to reduce or eliminate any undesirable clearances between the respective mating surfaces. The one or more intermediate mounting plates may be positioned between the mating surface of structure 144 and the mating surface of top assembly 143; and/or between the mating surface of vertical support 146 and the mating surface of bottom assembly 145. These one or more intermediate mounting plates may typically be metallic, for example, made of steel, and be mounted to their respective mating surfaces with mechanical fasteners, such as, nuts and bolts.

In one aspect, the fastener retaining the top assembly 143 to the bottom assembly 145 (for example, the bolt 68 and nuts 72 shown in FIG. 7) may be loosened where the top assembly 143 and the bottom assembly 145 are at least partially unrestrained, allowing at least some relative movement of the top assembly 143 with respect to the bottom assembly 145.

After mounting the top assembly 143 and bottom assembly 145, in one aspect the bottom assembly 145 is rotated in at least one direction, for example, in at least one of the directions indicated by the curved arrows 148, 149, and 151 in FIG. 17 or a combination of the two directions, to provide a desired orientation of the bottom assembly 145 relative to the top assembly 143. The direction of rotation indicated by arrow 148 may comprise rotation about the axis of elongation of the vertical support 146; the direction of rotation indicated by arrow 149 may comprise rotation about an axis substantially perpendicular to the axis of elongation of the vertical support 146; the direction of rotation indicated by arrow 151 may comprise rotation about an axis substantially perpendicular to the axis of elongation of the vertical support 146 (for example, about the axis of projections 150 in FIG. 17).

As disclosed herein, with the rotation of bottom assembly 143 (and possibly the rotation of vertical support 146 mounted to bottom assembly 143), the bearing surfaces in bottom assembly 143 and top assembly 145 slidably engage their corresponding opposing bearing surfaces, as disclosed herein, for example, allowing relative rotation of the bottom assembly 143 with respect to the top assembly 145.

In one aspect of the invention, interface device 142 (and interface device 36, 160, and 220) may include one or more projections or moment arms 150 operatively connected to bottom assembly 145 to assist the installer in rotating the bottom assembly (and rotating the vertical support 146), for example, in direction 148, 149, and/or 151, to obtain the desired orientation for bottom assembly 145. For example, in one aspect, one or more moment arms 150 may be provided where the installer can manually manipulate moment arms 150 to orient the bottom assembly 145 as desired. In one aspect, as shown in FIG. 17, moment arms 150 may be mounted, for example, rigidly mounted, to the bottom plate of bottom assembly 145. In other aspects, moment arms 150 may be mounted, for example, welded or attached with mechanical fasteners, where moment arms 150 can be used to manipulate bottom assembly 145. For example, moment arms 150 may comprise one or more extensions of an intermediate mounting plate (not shown) or one or more projections from an intermediate mounting plate.

In one aspect, moment arm 150 may comprise a bar, a rod, or a plate operatively mounted to bottom assembly 145, for example, a bar, a rod, or a plate mounted on a side, on top of, and/or on the bottom of the bottom plate of bottom assembly 145. In one aspect, one or more moment arms 150 may be mounted to top assembly 143, for example, with or without the presence of one or more moment arms 150 mounted to bottom assembly 145.

Once the bottom assembly 145 is positioned as desired, the fastener 50 (see FIG. 7), which at least partially retains the bottom assembly 143 to the top assembly 145, may be tightened, for example, manually with a wrench or with a pneumatic drill, to substantially fix the bottom assembly 143 and the top assembly 145 in their desired orientations.

Figure 18:
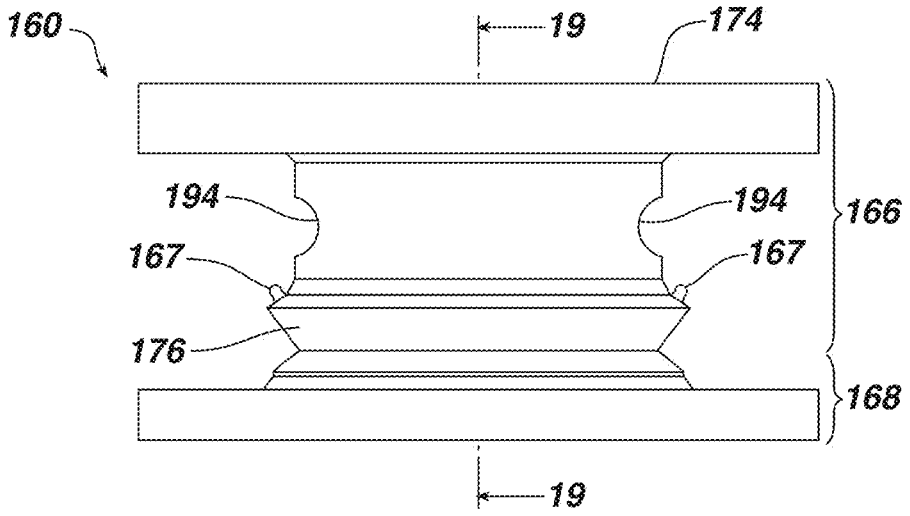
FIG. 18 is a front elevation view of an interface device according to another aspect of the invention, the rear elevation view being a mirror image thereof.
Figure 19:
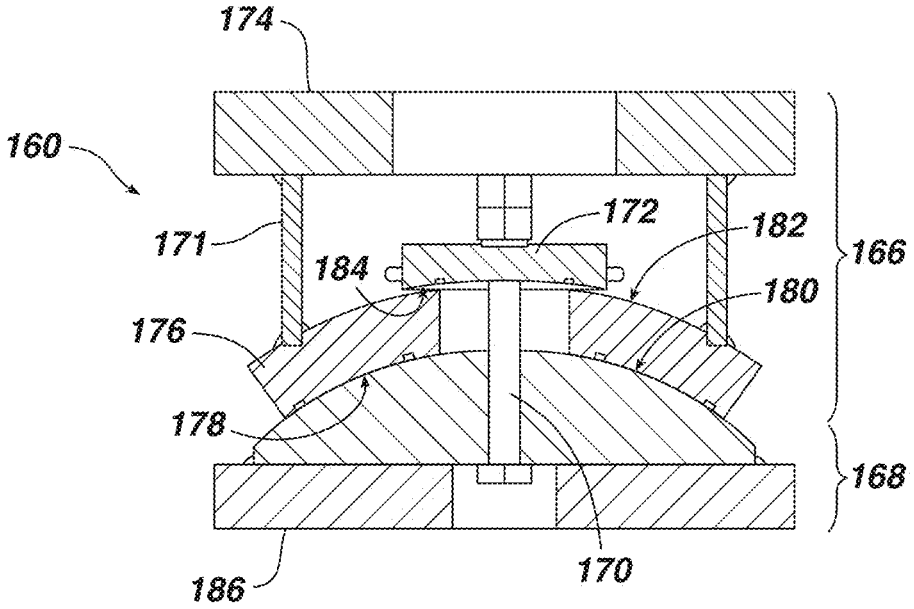
FIG. 19 is a cross-sectional view of the interface device shown in FIG. 18, as viewed along section lines 19-19 shown in FIG. 18.

FIG. 18 is a front elevation view of an interface device 160 according to another aspect of the invention, the rear elevation view being a mirror image thereof. FIG. 19 is a cross-sectional view of the interface device 160 shown in FIG. 18, as viewed along section lines 19-19 shown in FIG. 18. Interface device 160 may have all the features and attributes of interface devices 36 and 142 disclosed herein, for example, having an upper assembly 166 pivotally adjustable to lower assembly 168. However, according to this aspect of the invention, interface device 160 includes lubricant distribution channels, recesses, or grooves, that is, "grease grooves," in one or more of the bearing surfaces for introducing a lubricant to the bearing surfaces. As shown most clearly in FIG. 18, top assembly 166 may include one or more lubricant introduction ports or fittings 167, for example, a grease fitting, adapted to receive a lubricant and transfer the lubricant via lubricant distribution passages to the bearing surfaces. In one aspect, the lubricant introduced to the bearing surfaces may reduce friction between the mating bearing surfaces and/or reduce the oxidation, that is, rusting, of one or both of the mating bearing surfaces. In one aspect, the lubricant may be a petroleum-based lubricant, for example, an oil or a grease. However, in other aspects, a non-petroleum-based lubricant may be introduced, or example, a graphite-based lubricant or a PTFE-based lubricant, or the like.

As shown in FIGS. 18 and 19, in a fashion similar to interface devices 36 and 142 disclosed herein, support-to-structure interface device 160 includes a top assembly 166 and a bottom assembly 168 connected to the top assembly 166 by a fastener 170 and a retaining ring 172. As disclosed herein, top assembly 166 may include a mounting ring or cylinder 171, for example, having all the features and attributes of mounting cylinder 78 disclosed herein, for example, mounting cylinder 171 may be a hollow circular cylinder. Fastener 170 may have all the attributes of fastener 50 disclosed herein, for example, fastener 170 may include a threaded bolt, a washer, and one or more threaded nuts. Retaining ring 172 may have all the attributes retaining ring 52 disclosed herein, for example, retaining ring 172 includes a radiused bearing surface 184. Details of one retaining ring 172 are provided in FIGS. 24, 25, and 26 and their descriptions below.

As shown in FIGS. 18 and 19, top assembly 166 includes a top plate or a top mounting plate 174 adapted to engage a structure (not shown), for example, an overhead beam, and a bearing ring 176 mounted to the top plate 174. According to aspects of the invention, the bearing ring 176 includes a radiused bearing surface, or a first radiused bearing surface, 178, adapted to bear against a radiused bearing surface, or a third radiused bearing surface, 180 of bottom assembly 168, and a radiused bearing surface, or a second radiused bearing surface, 182, opposite the first radiused bearing surface 178, and retaining ring 172 includes a radiused bearing surface, or a fourth radiused bearing surface, 184 adapted to bear against second radiused bearing surface 182 of bearing ring 176. In this aspect of the invention, one or more of radiused bearing surfaces 178, 180, 182 and 184 are provided with one or more lubricant distribution channels or grooves sized and adapted to introduce a lubricant to the mating surfaces. Details of one top assembly 166 are provided in FIGS. 20, 21, 22, 23, and 23A and their descriptions below.

As also shown in FIG. 19, the bottom assembly 168 includes a bottom plate or bottom mounting plate 186 adapted to engage a vertical support (not shown), for example, a column or post, and bottom assembly 168 includes a radiused bearing surface, or a third radiused bearing surface, 180. Bottom assembly 168 and mounting plate 186 may have all the features and attributes of bottom assembly 48 and bottom mounting plate 62, respectively, disclosed herein. According to aspects of the invention, the third radiused bearing surface 180 of bottom assembly 168 is adapted and shaped to contact, for example, slidably contact, the first radiused bearing surface 178 of the top assembly 166.

Figure 20:
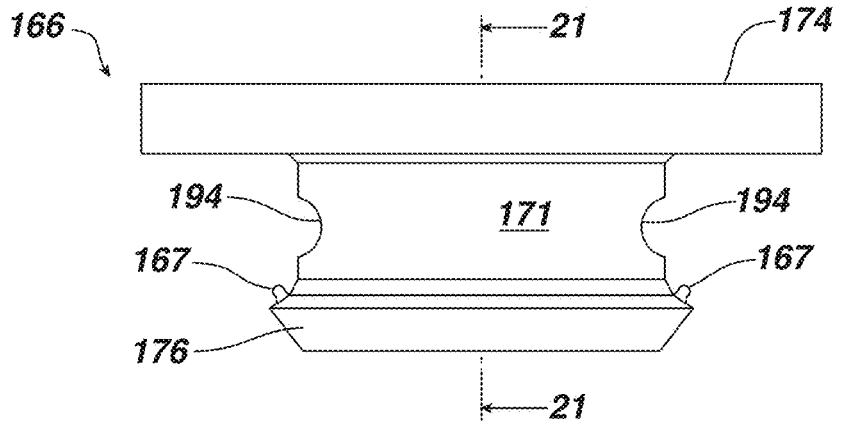
FIG. 20 is a front elevation view of the top assembly of the interface device shown in FIG. 18, the rear elevation view being a mirror image thereof.
Figure 21:
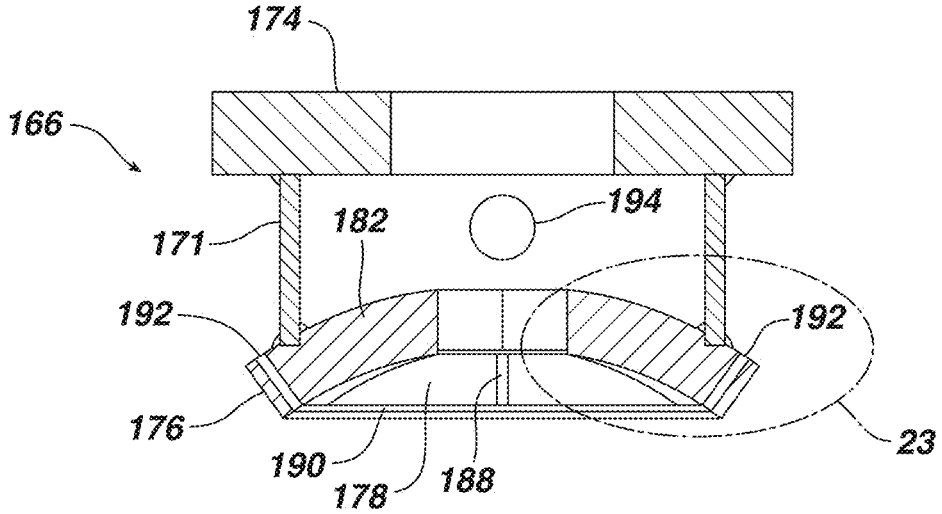
FIG. 21 is a cross-sectional view of the top assembly shown in FIG. 20, as viewed along section lines 21-21 shown in FIG. 20.
Figure 22:
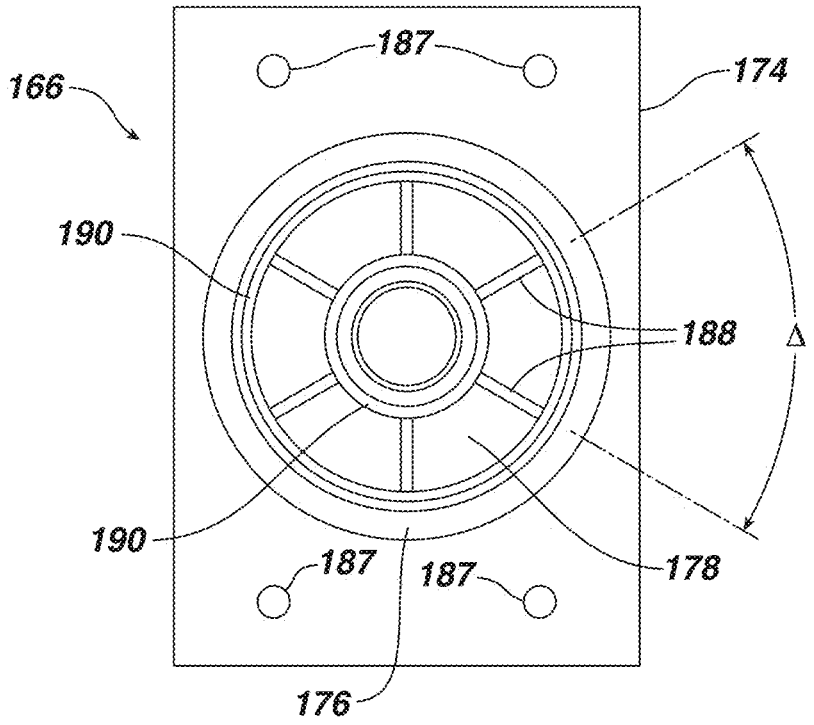
FIG. 22 is a bottom view of the top assembly of the interface device shown in FIG. 20.

FIG. 20 is a front elevation view of the top assembly 166 of the interface device 160 shown in FIG. 18, the rear elevation view being a mirror image thereof. FIG. 21 is a cross-sectional view of the top assembly 166 shown in FIG. 20, as viewed along section lines 21-21 shown in FIG. 20. FIG. 22 is a bottom view of the top assembly 166 shown in FIG. 20. As shown in FIGS. 20 and 21, top assembly 166 includes a top plate 174 and a bearing ring 176, and may include a mounting ring or mounting collar 171. According to this aspect, top plate 174, bearing ring 176, and mounting ring 171 may have all the attributes and features of top plate 54, bearing ring 56, and mounting ring 78, respectively, disclose herein. For example, as shown in FIGS. 20 through 22, top plate 174 may comprise a rectangular plate, bearing ring 176 includes lower or first radiused bearing surface 178 and upper or second radiused bearing surface 182, and mounting ring 171 may be circular cylindrical in shape. As shown in FIG. 22, top plate 54 may have mounting holes 187, which may be used to mount top assembly 166 to the intended structure (not shown), for example, with mechanical fasteners (not shown). Also, first radiused bearing surface 178 and second radiused bearing surface 182 may have a surface finish of at least 1000 μin., or at least 500 μin. or at least 250 μin. For example, in one aspect, first radiused bearing surface 178 may have an average roughness value of 250 μin. and second radiused bearing surface 182 may have an average roughness value of 500 μin.

According to the aspect shown in FIGS. 21 and 22, first radiused bearing surface 178 and second radiused bearing surface 182 of bearing ring 176 may include lubrication distribution channels 188 and 190. In the aspect shown in FIG. 21 only radiused bearing surface 178 includes lubrication destitution channels 188 and 190, though radiused bearing surface 182 may only have lubrication distribution channels 188 and 190, or both radiused bearing surface 178 and radiused bearing surface 182 may have lubrication distribution channels 188 and 190. As shown in FIG. 21, lubrication distribution channels 188 and 190 may be supplied by one or more lubrication ports 192, for example, having grease fittings 167 (shown in FIG. 20, but not shown in FIG. 21).

As also shown in FIG. 21, in one aspect, mounting collar 171 may include one or more through holes 194, or lubrication access openings, allowing access to lubrication ports (not shown) in retaining ring 172. Details of the lubrication ports and lubrication channels that may be provided in retaining ring 172 are shown and described with respect to FIGS. 24, 25, and 26.

According to aspects of the invention, as shown in FIGS. 21 and 22, bearing surface 178 of bearing ring 176 includes lubrication grooves or channels, specifically, one or more radial grooves 188 and one or more circumferential grooves 190. As shown in FIG. 22, radially directed channels 188 may be evenly spaced about the surface of radiused bearing surface 178, for example, evenly spaced at a circumferential angle A. The circumferential angle A in FIG. 22 is about 60 degrees, but the circumferential angle A may range from 10 degrees to 180 degrees, depending, among other things, on the size of interface device 160 and its loading. In one aspect, the circumferentially directed channels 190 may be evenly spaced about the surface of radiused bearing surface 178, for example, evenly spaced in a radial direction.

Figure 23A:
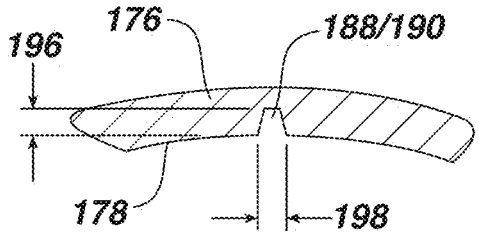
FIG. 23A is a detailed cross-sectional view of the lubrication channel shown in FIG. 23.
Figure 23:
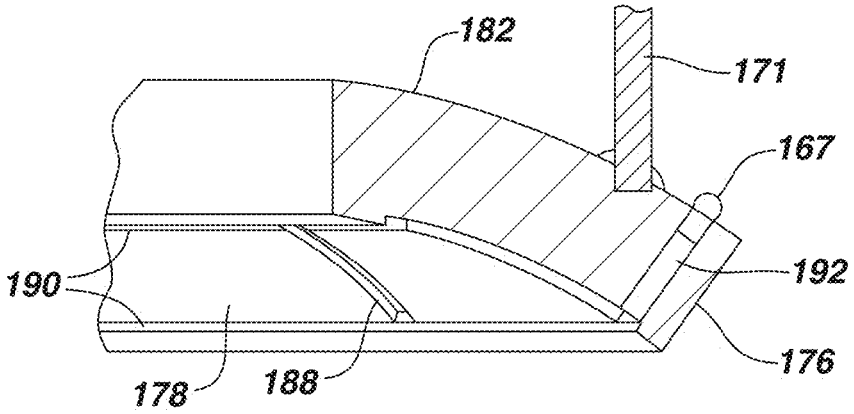
FIG. 23 is a detailed view of a portion of the cross section of the top assembly of the interface device shown in FIG. 21, as indicated by Detail 23 in FIG. 21.

FIG. 23 is a detailed view of a portion of the cross section of the top assembly 166 of the interface device shown in FIG. 21, as indicated by Detail 23 in FIG. 21 showing one set of radial grooves 188 and circumferential grooves 190 that may be provided according to one aspect of the invention. According to aspects of the invention, radial groves 188 and circumferential grooves 190 are in fluid communication, that is, groves 188 and circumferential grooves 190 intersect allowing lubricant to flow to and from a radial groove 188 and a circumferential groove 190. As shown most clearly in FIG. 23, radial groves 188 and circumferential grooves 190 may typically be fed, that is, be in fluid communication with, one or more lubrication ports 192. Lubrication ports 192 may be located in any convenient location in top assembly 166; however, in the aspect shown in FIG. 23, lubrication ports 192 are shown located in bearing ring 176. As also shown in FIG. 23, the one or more lubrication ports may be provided with a lubrication fitting 167, for example, a grease fitting, though other types of lubricant fittings or nipples adapted to receive a lubricant from a lubricant source, such as, a "grease gun," may be used. In one aspect, lubrication fitting 167 may be a Zerk-type lubrication fitting, or its equivalent.

FIG. 23A is a detailed cross-sectional view of a radial groove 188 or a circumferential groove 190 that may be provided in radiused bearing surface 178, and/or in radiused bearing surface 182. As shown in FIG. 23A, radial grooves 188 and circumferential grooves 190 have a depth 196 and a width 198. As shown in FIG. 23A, width 198 may vary from a maximum width at the surface 178 to a minimum width at a base of groove 188 or 190, that is, grooves 188 and 190 may be tapered. The depth 196 may vary from ¼ (0.25) inch to 1/16 (0.0625) inch, but is typically about ⅛ (0.125) inch in depth. The width 198 may vary from ⅛ (0.125) inch to ½ (0.5) inch, but is typically about 3/16 (0.1875) inch in width.

FIG. 24 is a front elevation view of the retaining ring 172 of the interface device 160 shown in FIG. 19, the rear elevation view being a mirror image thereof. FIG. 25 is a cross-sectional view of retaining ring 172 shown in FIG. 24, as viewed along section lines 25-25 shown in FIG. 24. FIG. 26 is a bottom view of the retaining ring 172 shown in FIG. 24.

Retaining ring 172 may have all the aspects and features of retaining ring 52 disclosed herein. For example, retaining ring 172 may be a circular, metallic plate 200 having a radiused bearing surface, or a fourth radiused bearing surface, 184, and a through hole 205. As shown must clearly in FIG. 19, through hole 205 may be provided to accommodate the fastener 170. As disclosed herein, fourth bearing surface 184 is adapted and shaped to contact the upper radiused bearing surface, or second radiused bearing surface, 60 of bearing ring 56 of top assembly 45 or is adapted and shaped to contact the upper radiused bearing surface, or second radiused bearing surface, 182 of bearing ring 176 of top assembly 166.

As shown in FIGS. 24, 25, and 26, in a fashion similar to bearing surfaces 178, 180, and 182, radiused bearing surface 184 may include one or more lubrication channels or grooves 204, for example, radially directed channels and/or circumferentially directed channels. In the aspect of the invention shown in FIGS. 24, 25, and 26, radiused bearing surface 184 includes a single circumferential channel 204, though two or more radial and/or circumferential channels 204 may be provided in surface 184. In one aspect, circumferentially directed channels 204 on surface 184 may be evenly spaced about the surface 184, for example, evenly spaced in a radial direction. When provided, radially directed channels (not shown) on surface 184 may be evenly spaced about the surface 184, for example, evenly spaced in a circumferential direction. The lubrication channels 204 in radiused bearing surface 180 may be dimensioned as shown in FIG. 23A.

As shown in FIGS. 24, 25, and 26, the one or more lubrication channels 204 in retaining ring 172 may typically be fed, that is, be in fluid communication with, one or more lubrication ports 206. Lubrication ports 206 may be located in any convenient location in plate 200; however, in the aspect shown in FIGS. 24, 25, and 26, lubrication ports 206 are shown evenly circumferentially spaced and substantially radially directed from the outer circumference of plate 200. As shown in FIG. 26, radially directed lubrication ports 206 may be evenly spaced about the outer circumference of plate 200, for example, evenly spaced at a circumferential angle ρ. The circumferential angle ρ in FIG. 26 is about 90 degrees, but the circumferential angle ρ may range from 10 degrees to 180 degrees, depending, among other things, on the size of interface device 160 and its loading.

Though not shown, the one or more lubrication ports may be provided with a lubrication fitting, for example, a grease fitting, though other types of lubricant fittings or nipples adapted to receive a lubricant from a lubricant source, such as, a "grease gun," may be used. In one aspect, lubrication fitting provided in one or more lubrication ports 206 may be a Zerk-type lubrication fitting, or its equivalent.

According to one aspect of the invention, the one or more through holes 194 in mounting collar 171 of top assembly 166 (see FIG. 21) may be provided to facilitate access to the lubrication ports 206 or lubrication fittings in retaining ring 172, for example, for introducing a lubricant to the lubrication fittings in retaining ring 172 with a grease gun, among other means.

Though not shown, it is envisioned that the radiused bearing surface 180 of bottom assembly 168 (see FIG. 19) may include one or more lubrication channels or grooves, for example, radially directed channels and/or circumferentially directed channels. The lubrication channels in radiused bearing surface 180 may be dimensioned as shown in FIG. 23A. The lubrication channels in bearing surface 180 may be in fluid communication with one or more lubrication ports (similar to lubrication ports 192 in bearing ring 176—see FIG. 23, or to lubrication ports in retaining ring 172) in bottom assembly 168, and the lubrication ports in bottom assembly 168 may include lubrication fittings, such as, Zerk-type lubrication fittings.

Figure 27:
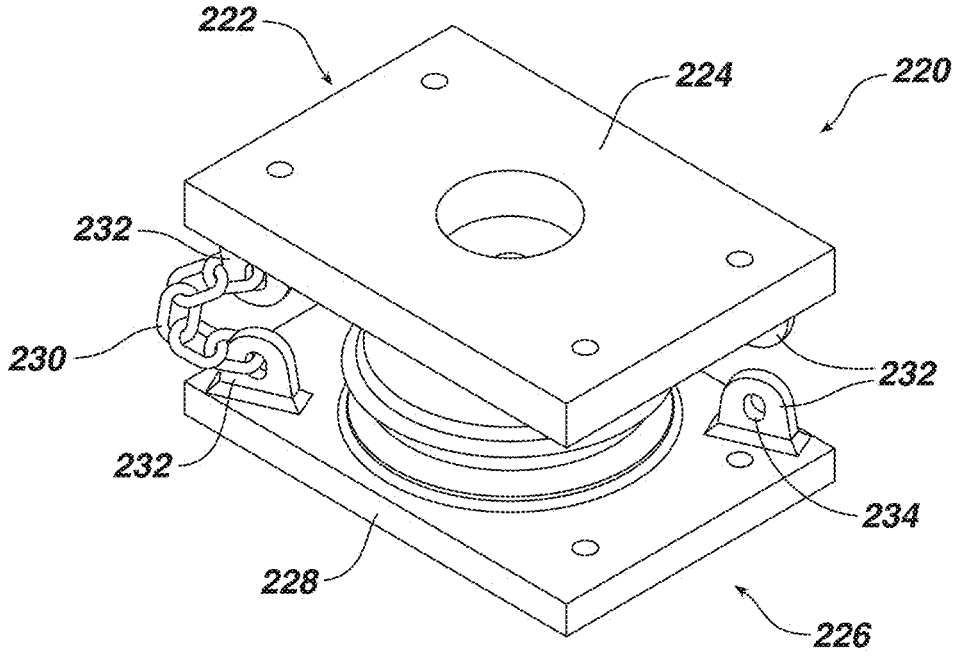
FIG. 27 is a perspective view of a support-to-structure interface device according to another aspect of the invention.
Figure 28:
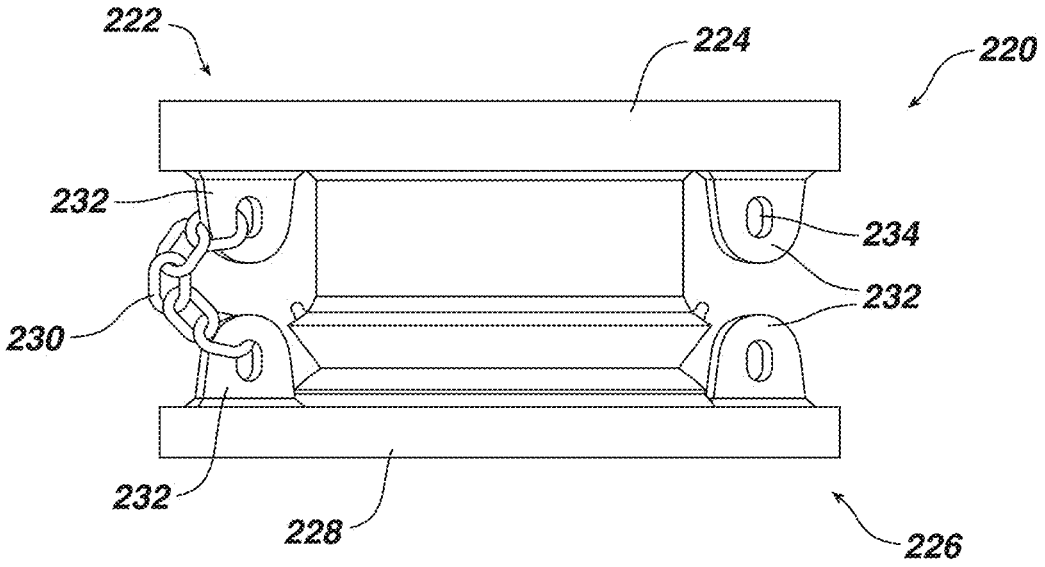
FIG. 28 is a front elevation view of the interface device shown in FIG. 27, the rear elevation view being a mirror image thereof.

FIG. 27 is a perspective view of a support-to-structure interface device 220 according to another aspect of the invention. FIG. 28 is a front elevation view of the interface device 220 shown in FIG. 27, the rear elevation view being a mirror image thereof. Interface device 220 may have all the features and attributes of interface devices 36, 142, and 166 as disclosed herein. For example, interface device 220 may have a top assembly 222 having a top plate 224 and a bottom assembly 226 having a bottom plate 228, and may have lubrication channels or grooves similar to lubrication channels 188, 190, and 204 shown and disclosed with respect to FIGS. 21 through 26. However, according to this aspect of the interface device 220 is adapted to have at least one tether 230 mounted to top assembly 222 and to bottom assembly 226.

As disclosed herein, the term "tether" may refer to any elongated, flexible (that is, bendable), tensile element or member having a first end adapted to engage top assembly 222 and having a second end, opposite the first end, adapted to engage bottom assembly 226. Typically, tether 230 may be substantially non-extendable, for example, allowing little or no axial extension under an expected loading. However, in one aspect, tether 230 may be extendable, for example, having some extendibility, such as, a "bungee cord" and the like.

According to this aspect of the invention, the at least one tether 230 is provided to minimize or prevent the disengagement of top assembly 222 from the bottom assembly 226, for example, due to failure of one or both of the top assembly 222 or the bottom assembly 226. For example, in one aspect, tether 230 may be referred to as a "safety tether" or a "safety chain," where should, for example, a component of top assembly 222 fail, for example, due to loading or mishandling, bottom assembly 226, and any support (not shown) to which bottom assembly 226 is mounted, may be retained by the one or more tethers 230.

In one aspect, tether 230 may be any elongated, flexible, tensile member sized to withstand the expected loading that tether 230 may experience without failure. For example, in some aspects, tether 230 may be a cable, such as, as steel cable; a rope, for example, a rope made from natural or synthetic materials; or a cord (for example, for lightly loaded applications). However, in one aspect, tether 230 may typically be a chain as shown in FIGS. 27 and 28, for example, a linked chain, having a tensile capacity or "working load limit" (WLL), required for the application. For example, in one aspect, the tensile capacity of tether 230 may be at least twice the required arresting force of the complete assembly. As known in the art, an "arresting force" is the force required to stop, or "arrest," the fall of the assembly of, for example, the bottom assembly 226 and the support (such as, support 256 shown in FIG. 31) to which bottom assembly 226 is mounted. In one aspect, when tether 230 comprises a chain, tether 230 may be a Grade 100 alloy-steel chain, for example, a Grade 100 alloy steel chain provided by Peerless Chain of Winona, Minnesota, or its equivalent.

The length of tether 230 may vary depending upon the application. However, the length of tether 230, for example, a chain, may range from 6 inches to 3 feet, but is typically between 8 inches and 24 inches, for example, about 12 inches in length.

In one aspect, the one or more tethers 230 may be mounted to top assembly 222 and to lower assembly 226 by any conventional means and at any convenient locations. However, in one aspect, the one or more tethers 230 may be mounted to top plate 224 of top assembly 222 and to bottom plate 228 bottom assembly 226. In one aspect, tether 230 may be mounted to top plate 224 and to bottom plate 228 by any conventional means, for example, with mechanical fasteners, such as, "eye bolts," "lifting eyes," or "hoist rings," among other fasteners; threaded; welded; retained by an adhesive to top plate 224 and bottom plate 228; or by one or more through-holes in top plate 224 and bottom plate 228 engageable by tether 230.

However, in one aspect, the one or more tethers 230 may be mounted to top plate 224 of top assembly 222 and to bottom plate 228 of bottom assembly 226 by one or more perforated tether plates 232, as shown in FIGS. 27 and 28. Tether plates 232 typically have at least one through hole 234 sized and located to receive tether 230, but may have two or more through holes. Though closed holes 234 may be preferred, in one aspect, holes 234 may be open holes, for example, slots. In the aspect of the invention shown in FIGS. 27 and 28, tether plates 232 are welded to top plate 224 and bottom plate 228, for example, by fillet welds, such as, shielded metal arc welded (SMAW) fillet welds. In one aspect, tether plates 232 may be integrally formed with top plate 224 and bottom plate 228, for example, forged or cast as an integral component.

Figure 30:
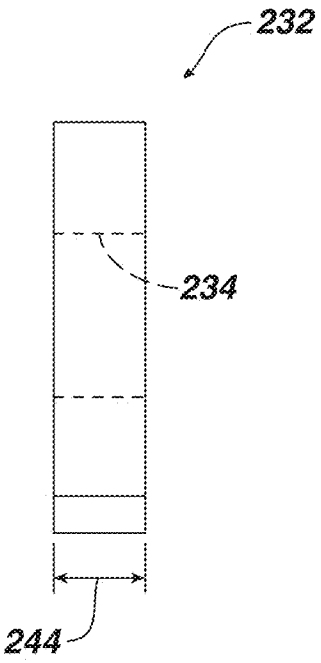
FIG. 30 is a right-side elevation of the tether plate shown in FIG. 29, the left-side elevation view being a mirror image thereof.
Figure 29:
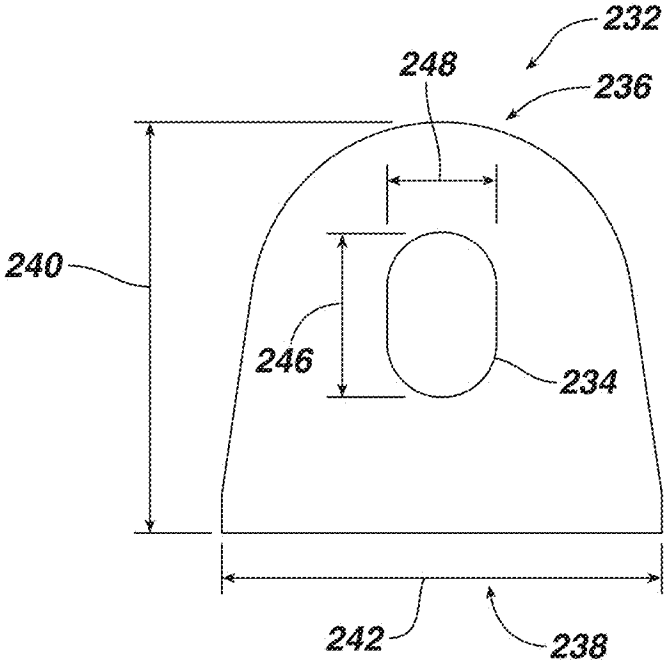
FIG. 29 is a top plan view of one of the tether plates shown in FIGS. 27 and 28, the bottom view being a mirror image thereof.

FIG. 29 is a top plan view of the tether plate 232 shown in FIGS. 27 and 28, the bottom view being a mirror image thereof. FIG. 30 is a right-side elevation view of the tether plate 232 shown in FIG. 29, the left-side elevation view being a mirror image thereof. As shown, tether plate 232 may include one or more through holes 234 and tether plate 232 may be generally rectangular in shape. In one aspect, tether plate 232 may have a radiused first or upper end 236 for example, adapted to facilitate engagement with tether 230, and a planar second or lower end 238 for example, adapted to facilitate mounting to top plate 224 and to bottom plate 228, for example, by welding.

Tether plate 232 may have a height 240 ranging from 1 inch [in.] to 24 in., but typically has a height 240 ranging from 2 in. to 6 in., for example, about 3 in. Tether plate 232 may have a width 242 ranging from 1 in. to 24 in., but typically has a width 242 ranging from 2 in. to 6 in., for example, about 3 in. Tether plate 232 may have a thickness 244 ranging from ¼ in. (0.25 in.) in. to 3 inches, but typically has a thickness 244 ranging from ½ in (0.50 in.) to 1 in., for example, ⅝ in. (0.625 in.).

Through hole 234 may be circular, rectangular, square, or oval, as shown. Through hole 234 may have a height or diameter 246 ranging from 1 in. to 6 inches, but typically has a height or diameter 246 ranging from 1 in. to 3 in., for example, about 1⅛ in. (1.125 in.). Through hole 234 may have a width 248 ranging from ½ in. (0.5 in.) to 3 in., but typically has a width 248 ranging from 1 in. to 2 in., for example, 1¼ in. (1.25 in.).

As other components of aspects of the invention, tether plate 232 may be metallic, for example, made of any structural metal, including aluminum, steel, stainless steel, or titanium, among other structural metals, depending upon the expected loading on tether plate 232. In one aspect, tether plate 232 may be made from an ASTM A709 high-strength, low-alloy structural plate, for example, ASTM A709 Grade 50 steel plate, or its equivalent.

Figure 31:
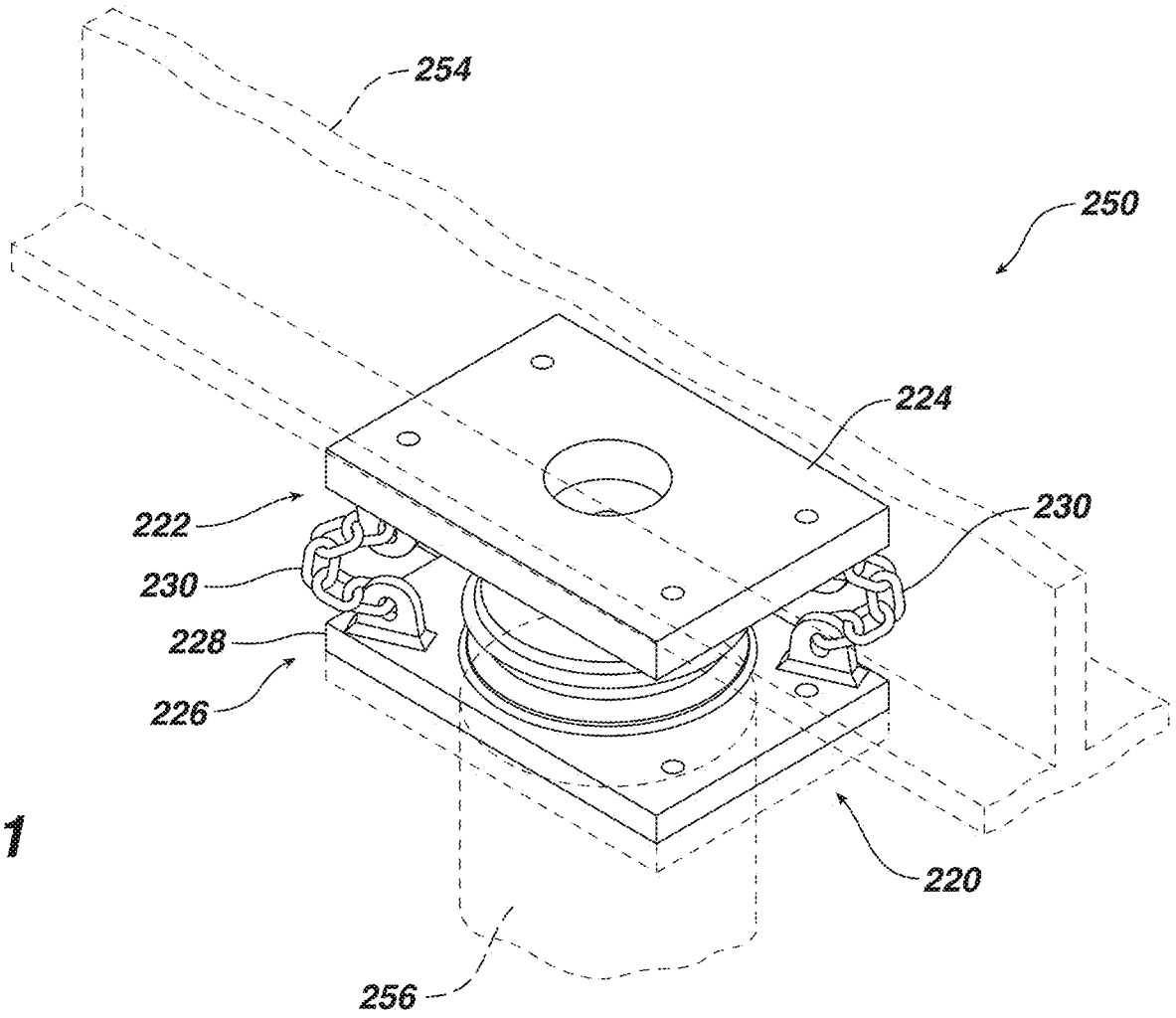
FIG. 31 is a perspective view of an arrangement of the interface device shown in FIGS. 27 and 28 according to an aspect of the invention when mounted between a structure (shown in phantom) and a vertical support (shown in phantom).

FIG. 31 is a perspective view of an arrangement 250 of the interface device 220 shown in FIGS. 27 and 28 according to an aspect of the invention when mounted between a structure 254 (shown in phantom) and a vertical support 256 (shown in phantom). As shown in FIG. 31, the structure 254 may be a wide-flanged beam, only a portion of which is shown in FIG. 31, and the vertical support 256 may be a circular column, only a portion of which is shown in FIG. 31. As disclosed herein, interface device 220 may be similar to, if not identical to, and have the same function as interface devices 36, 142, or 160 disclosed herein. Specifically, interface device 220 includes top assembly 222 having top plate 224 and bottom assembly 226 having a top plate 228. In the aspect shown in FIG. 31, top assembly 222 and bottom assembly 226 may be connected by tether 230. In the aspect shown, tether 230 comprises a linked chain.

As disclosed herein, tether 230 may be provided as a safety precaution and/or to prevent total disengagement of top assembly 222 and bottom assembly 226, for instance, due the failure of the connecting fastener or failure of the mounting fasteners. Tether 230 may be mounted to top assembly 222 and bottom assembly 226 by any conventional means, for example, by engagement with the through holes 234 of tether plates 232.

It is envisioned that, though not shown in FIG. 31, the arrangement 250 shown in FIG. 31 may include one or more intermediate mounting plates or "shims" (not shown). For example, one or more intermediate mounting plates may be provided to facilitate engagement with interface device 220 and/or to reduce or eliminate any undesirable clearances between the respective mating surfaces.

In one aspect, the use of an interface device 36, 142, 160, or 220 may be used to substantially permanently support the structure 144 or 254 by vertical support 146 or 256, for example, during the expected entire life of the structure 144 or 254 and vertical support 146 or 256. In another aspect of the invention, an interface device 36, 142, 160, or 220 may be used for temporary support of structure 144 or 254, for example, during the servicing or replacement of structure 144 or 254. According to the temporary use of interface device 36, 142, 160, or 220, after servicing or replacement of structure 144 or 254, interface device 36, 142, 160, or 220 and vertical support 146 or 256 may be removed and, for example, installed on the same or a different structure 144 or 254. In one aspect, two or more interface devices 36, 142, 160, or 220 may be used to support one or more structures 144 or 254 for a substantially permanent support or a temporary support by one or more vertical supports 146 or 256.

As disclosed herein, support-to-structure interface devices and methods of supporting structures are provided. The interface devices and methods overcome the disadvantage and limitations of the prior art by providing devices that can vary the angle of engagement with respective structures and supports to provide a proper structural engagement and support to otherwise misaligned mounting surfaces. Though aspects of the invention may be uniquely adapted for use in highway or bridge construction, aspects of the invention may be employed in any installation, large or small, where mating surfaces may be misaligned yet require engagement and support.

The terminology used herein is for the purpose of describing particular embodiments only and is not intended to be limiting of the disclosure. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A support-to-structure interface device comprising:

a top assembly having a top plate configured to engage a structure and a bearing ring mounted to the top plate, the bearing ring having a first radiused bearing surface and a second radiused bearing surface opposite the first radiused bearing surface;

a bottom assembly having a bottom plate configured to engage a vertical support and a third radiused bearing surface having a radiused shape configured adapted and shaped to contact the first radiused bearing surface of the top assembly, wherein the top assembly is rotatable against the bottom assembly;

a retaining ring defining a fourth radiused bearing surface having a radiused shape configured to contact the second bearing surface of the top assembly; and a fastener configured to retain the top assembly on the bottom assembly.

2. The interface device as recited in claim 1, wherein the structure comprises a beam.

3. The interface device as recited in claim 1, wherein the vertical support comprises a column.

4. The interface device as recited in claim 1, wherein the interface device further comprises at least one moment arm operatively connected to the bottom assembly.

5. The interface device as recited in claim 1, wherein the top assembly further comprises a mounting cylinder positioned between the top plate and the bearing ring.

6. The interface device as recited in claim 5, wherein the mounting cylinder comprises one of a circular cylindrical mounting cylinder and a polygonal cylindrical mounting cylinder.

7. The interface device as recited in claim 1, wherein the bottom assembly further comprises a bearing dome, and wherein the third radiused bearing surface is located on the bearing dome.

8. The interface device as recited in claim 7, wherein the bearing dome comprises a spherical dome.

9. The interface device as recited in claim 1, wherein the top assembly is rotatable against the bottom assembly about at least one axis.

10. The interface device as recited in claim 9, wherein the top assembly is rotatable against the bottom assembly about at least two axes.

11. A method for supporting a structure, the method comprising:

providing the interface device as recited in claim 1;

mounting the top assembly to the structure;

mounting the bottom assembly to the vertical support;

at least partially retaining the top assembly onto the bottom assembly with the retaining ring and the fastener;

rotating the partially retained bottom assembly with respect to the top assembly to provide a desired orientation of the bottom assembly relative to the top assembly; and retaining the bottom assembly in the desired orientation by tightening the fastener.

12. The method as recited in claim 11, wherein rotating the partially retained bottom assembly with respect to the top assembly is practiced with a moment arm operatively connected to the bottom assembly.

13. The method as recited in claim 11, wherein the desired orientation comprises alignment of a surface of the top plate of the top assembly with a surface of the structure and alignment of a surface of the bottom plate of the bottom assembly with a surface of the support.

14. The method as recited in claim 11, wherein rotating the partially retained bottom assembly with respect to the top assembly comprises slidably engaging the third radiused bearing surface of the bottom assembly with the first radiused bearing surface of the top assembly.

15. The method as recited in claim 14, wherein rotating the partially retained bottom assembly with respect to the top assembly further comprises slidably engaging the fourth radiused bearing surface of the retaining ring with the second radiused bearing surface of the top assembly.

16. A column-to-structure interface device comprising:

a top assembly having a top plate configured to engage a structure and a bearing ring mounted to the top plate, the bearing ring having a first radiused bearing surface and a second radiused bearing surface opposite the first radiused bearing surface;

a bottom assembly having a bottom plate configured to engage a column and a third radiused bearing surface having a radiused shape configured to contact the first radiused bearing surface of the top assembly, wherein the top assembly is rotatable against the bottom assembly about at least one axis;

a mounting cylinder positioned between the top plate and the bearing ring;

a retaining ring defining a fourth radiused bearing surface having a radiused shape configured to contact the second bearing surface of the top assembly; and a fastener configured to retain the top assembly on the bottom assembly.

17. The interface device as recited in claim 16, wherein the mounting cylinder comprises one of a circular cylindrical mounting cylinder and a polygonal cylindrical mounting cylinder.

18. The interface device as recited in 16, wherein the top assembly is rotatable against the bottom assembly about at least two axes.

19. The interface device as recited in claim 16, wherein the bottom assembly further comprises a bearing dome, and wherein the third radiused bearing surface is located on the bearing dome.

20. The interface device as recited in claim 19, wherein the bearing dome comprises a spherical dome.

* * * * *